US007972243B2

(12) United States Patent
Kado et al.

(10) Patent No.: US 7,972,243 B2
(45) Date of Patent: Jul. 5, 2011

(54) CONTROL DEVICE FOR PLURAL PROPULSION UNITS

(75) Inventors: Takuya Kado, Shizuoka-ken (JP); Shu Akuzawa, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 848 days.

(21) Appl. No.: 11/971,860

(22) Filed: Jan. 9, 2008

(65) Prior Publication Data

US 2008/0166932 A1 Jul. 10, 2008

(30) Foreign Application Priority Data

Jan. 9, 2007 (JP) ..... 2007-001119

(51) Int. Cl.
*B63H 21/21* (2006.01)
*B63H 23/28* (2006.01)

(52) U.S. Cl. ..... 477/113; 440/1; 440/87

(58) Field of Classification Search ..... 477/113
See application file for complete search history.

(56) References Cited

U.S. PATENT DOCUMENTS 7,153,174 B2 * 12/2006 Takada et al. ..... 440/1
7,497,747 B2 * 3/2009 Kado et al. ..... 440/1
7,530,865 B2 * 5/2009 Kado et al. ..... 440/1
2008/0160845 A1 * 7/2008 Kado et al. ..... 440/1
2010/0227516 A1 * 9/2010 Kinoshita et al. ..... 440/87

FOREIGN PATENT DOCUMENTS

JP 08-200110 8/1996
JP 2000-313398 11/2000

OTHER PUBLICATIONS

U.S. Appl. No. 11/966,100, filed Dec. 28, 2007, entitled Control System for Propulsion Unit.
U.S. Appl. No. 11/966,984, filed Dec. 28, 2007, entitled Propulsion Unit Control.
U.S. Appl. No. 12/020,499, filed Jan. 25, 2008, entitled Control Device for Plural Propulsion Units.

* cited by examiner

*Primary Examiner* — Sherry Estremsky
(74) *Attorney, Agent, or Firm* — Keating & Bennett, LLP

(57) ABSTRACT

A control device for propulsion units is adapted to synchronize the engine rotational speeds of a plurality of propulsion units arranged in a row on a vessel and operatively and electrically connected to two control levers that are positioned adjacent to each other. The control device synchronizes the engine rotational speeds by correcting the throttle opening of a target propulsion unit or units based on a deviation between the engine rotational speed of a reference propulsion unit and the engine rotational speed of the target propulsion unit. Upon cancellation of synchronization, the throttle opening correction is reduced stepwise from its corrected throttle opening to its natural throttle opening based on the position of the corresponding control lever. As such, large fluctuations in engine speeds are avoided upon cancellation of synchronization.

13 Claims, 21 Drawing Sheets

CONTROL DEVICE FOR PLURAL PROPULSION UNITS

CROSS-REFERENCE TO RELATED APPLICATIONS

The present application is based on and claims priority under 35 U.S.C. §119 to Japanese Patent Application Serial No. 2007-001119, filed on Jan. 9, 2007, the entire contents of which are expressly incorporated by reference herein.

BACKGROUND OF THE INVENTION

1. Field of the Invention

The present invention relates to a control device for propulsion units of a vessel having a plurality of propulsion units arranged side by side, and more particularly to a control device that selectively synchronizes the engine rotational speeds of the propulsion units.

2. Description of the Related Art

There are vessels having, for example, three propulsion units such as outboard motors, stern drives, inboard-outboard motors or the like arranged at the stern. Conventionally, in a vessel of this type, a shift lever and a throttle lever are provided for each one of the propulsion units. However, it can be complicated to operate all of the shift levers and throttle levers (six in total) in addition to a steering wheel.

A recently-developed vessel has operation control units for controlling the operating conditions of respective outboard motors that are connected to each other by communication lines for transferring operating information of respective outboard motors (See Japanese Publication No. JP-A-Hei 8-200110). Also, a vessel has been developed in which the shifts and throttles of a plurality of propulsion units are operable by two control levers laterally disposed adjacent to each other. If a difference occurs between the engine rotational speeds of the engines of the right and left propulsion units when the control levers are tilted at the same angle, based for example on the engine rotational speed of the engine of the right propulsion unit, a motor in a throttle drive part is driven to adjust the throttle and thus eliminate the difference between this engine rotational speed and the engine rotational speed of the left propulsion unit. As such, the engine rotational speeds of the right and left engines are synchronized (see Japanese Publication No. JP-A-2000-313398).

SUMMARY OF THE INVENTION

Although as described above the engine rotational speeds of the propulsion units are synchronized when the right and left control levers are tilted at the same angle, there are conditions in which synchronization of the propulsion units is cancelled. If, during synchronization, the throttle opening of a target propulsion unit had been corrected in order to synchronize the engine speed of the target propulsion unit with that of a reference propulsion unit, cancellation of such correction may cause a sudden engine speed change in the target propulsion unit. Particularly large engine speed changes may result upon cancellation of synchronization control if the throttle opening correction during synchronization was large.

Accordingly, there is a need in the art for a control device for propulsion units that is adapted to prevent large engine speed fluctuations when control for the synchronization of engine rotational speeds is cancelled.

In accordance with one embodiment, the present invention provides a propulsion unit control system for a vessel having plural propulsion units arranged side by side and electrically connected in association with two adjacent control levers that are controllable by an operator to operate a shift actuator and/or a throttle actuator of a corresponding one of the propulsion units. The control system comprises engine rotational speed detection devices adapted to detect an engine rotational speed of a reference propulsion unit and an engine rotational speed of a target propulsion. A control device is configured to control the engine rotational speed of the target propulsion unit. The control device is adapted to synchronize the engine rotational speeds of the reference and target propulsion units by correcting the throttle opening of the target propulsion unit based on a deviation between the engine rotational speed of the reference propulsion unit and a natural engine rotational speed of the target propulsion unit that corresponds to a position of the control lever associated with the target propulsion unit. The control device is configured so that, when synchronization of the engine rotational speeds is cancelled, the correction of the throttle opening of the target propulsion device is reduced stepwise from the corrected throttle opening to the natural throttle opening.

In one such embodiment, the stepwise reduction in the throttle opening is carried out in every cycle.

In another embodiment, the amount by which the correction of the throttle opening is reduced in one step is set based on the engine rotating speed.

In a further embodiment, a period of correction of the throttle opening is set based on the engine rotational speed of the target propulsion unit. Another embodiment further comprises a vessel speed detection device for detecting a speed of the vessel, and the period of correction of the throttle opening is set based on the speed of the vessel. In still another embodiment, the amount by which the correction of the throttle opening is reduced in one step is set based on the engine rotating speed.

In yet another embodiment the control device is configured so that cancellation of synchronization of the engine rotational speeds occurs only after correction of the throttle opening has been completed.

In accordance with another embodiment, a method is provided for controlling a plurality of propulsion units that are mounted side by side on a boat and are electrically connected with two adjacent control levers that are controllable by an operator to operate a shift actuator and/or a throttle actuator of a corresponding one of the propulsion units. The method comprises providing engine rotational speed detection devices, detecting an engine rotational speed of a reference propulsion unit, detecting an engine rotational speed of a target propulsion unit, providing a control device configured to control the engine rotational speed of the target propulsion unit, calculating a deviation between the engine rotational speed of the reference propulsion unit and a natural engine rotational speed of the target propulsion unit that corresponds to a position of the control lever associated with the target propulsion unit, and synchronizing the engine rotational speeds of the reference and target propulsion units by correcting the throttle opening of the target propulsion unit based on the calculated deviation. Upon cancellation of synchronization, the method further comprises reducing the correction of the throttle opening of the target propulsion device in a stepwise manner from the corrected throttle opening to the natural throttle opening.

DETAILED DESCRIPTION OF PREFERRED EMBODIMENTS

Description is hereinafter made of embodiments of a control device for plural propulsion units. The embodiments discussed herein illustrate certain inventive principles in the context of specific embodiments, and the present invention is not limited to the embodiments discussed herein.

Figure 1:
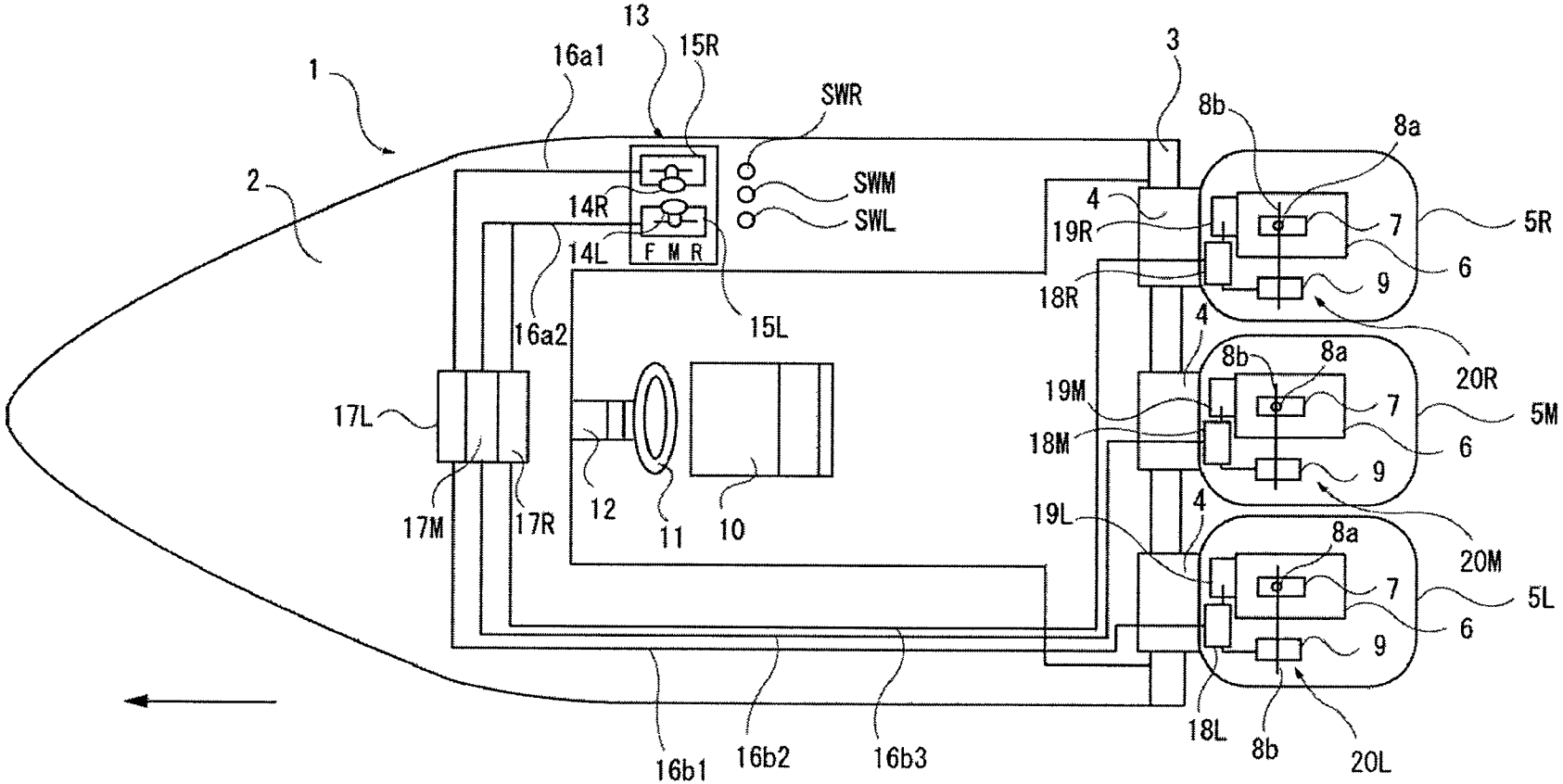
FIG. 1 is a schematic plan view of a vessel provided with an embodiment of a control device for plural propulsion units.
Figure 2:
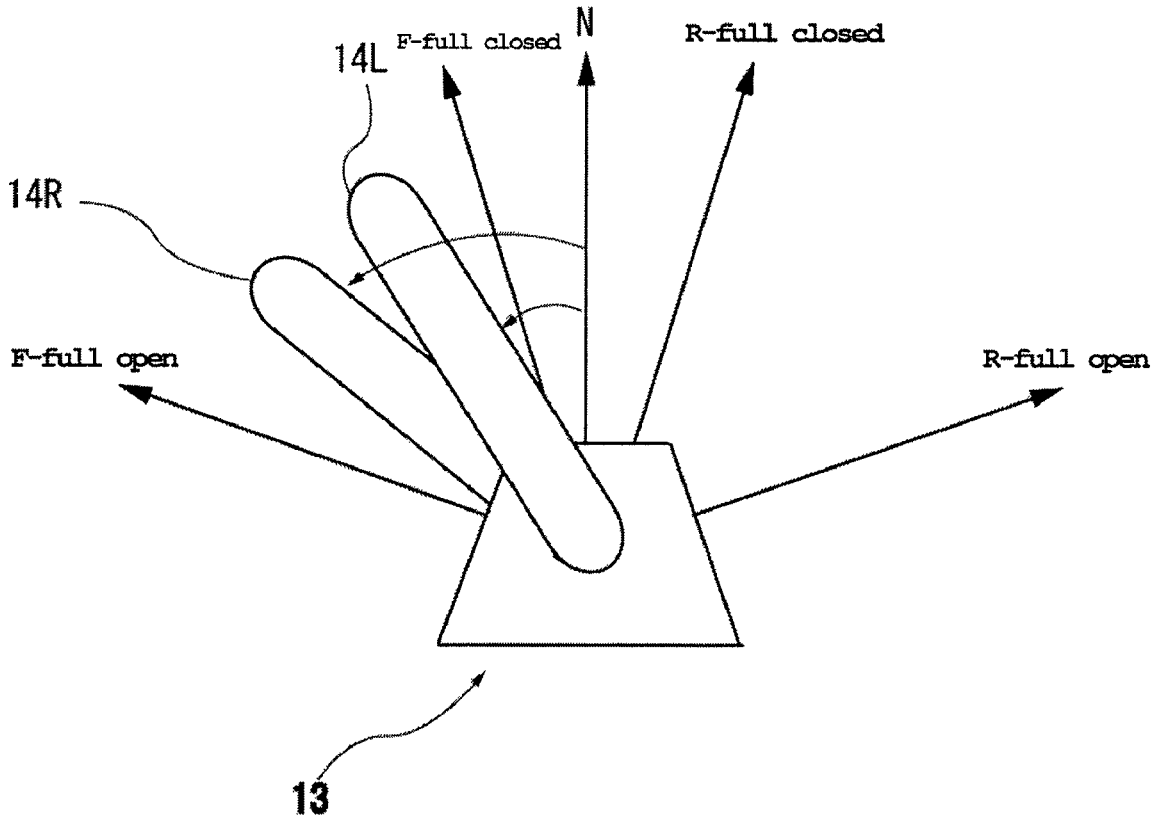
FIG. 2 is a view illustrating an embodiment of a remote controller.

FIG. 1 is a schematic plan view of a vessel provided with a control device for plural propulsion units according to a preferred embodiment, and FIG. 2 is a view illustrating a remote controller. The vessel of this embodiment, which has three propulsion units on its hull, needs to have a plurality of, that is, at least two propulsion units.

As illustrated, a vessel 1 has a hull 2, and three propulsion units 5L, 5M and 5R each attached to a stern board 3 of the hull 2 via a clamp bracket 4. While outboard motors are used as the propulsion units in this embodiment, the propulsion units may be stern drives or inboard-outboard motors, or other propulsion arrangements. For the sake of explanation, the propulsion unit on the left with respect to the forward travel direction of the vessel indicated by an arrow in FIG. 1 is referred to as "propulsion unit 5L on one side," the propulsion unit on the right is referred to as "propulsion unit 5R on the other side," and the propulsion unit at the center is referred to as "propulsion unit 5M at the center." For example, when the vessel has two propulsion units, the propulsion unit on the left of the two propulsion units on both sides is referred to as "propulsion unit 5L on one side," and the propulsion unit on the right is referred to as "propulsion unit 5R on the other side". When the vessel has four propulsion units, the propulsion unit on the left of the two propulsion units on both sides is referred to as "propulsion unit 5L on one side," the propulsion unit on the right is referred to as "propulsion unit 5R on the other side," and the two propulsion units at the center are referred to as "propulsion units 5M at the center". A similar arrangement also applies when the vessel has five propulsion units.

Each of the propulsion units 5L, 5M and 5R has an engine 6. Each engine 6 has an air intake system having a throttle body 7 (or carburetor) for adjusting the amount of intake air to be introduced into the engine 6 to control the engine rotational speed and torque of the engine 6. Each throttle body 7 has a motor-operated throttle valve 8*a*. Each throttle valve 8*a* preferably has a valve shaft 8*b* connected to a motor 9. The motor-operated throttle valves 8*a*, which can be opened and closed by driving the motors 9 by electronic control, preferably are electronic throttle mechanisms 20L, 20M and 20R. A manual steering wheel 11 for steering the vessel 1 is provided in front of an operator's seat 10 on the hull 2. The steering wheel 11 is attached to the hull 2 via a steering wheel shaft 12.

A remote controller 13 for controlling the operation of the propulsion units 5L, 5M and 5R is provided on one side of the operator's seat 10. The remote controller 13 has a left remote control lever 14L located on the left side with respect to the forward travel direction of the vessel and a right remote control lever 14R located on the right side, and lever position sensors 15L and 15R for detecting the lever positions of the remote control levers 14L and 14R, respectively. Each of the lever position sensors 15L and 15R is constituted of a potentiometer, for example. Each of the propulsion units 5L, 5M and 5R is operatively and electrically connected to the two remote control levers 14L and 14R arranged adjacent to each other, and has a shift driving device and a throttle driving device operable in light of operator input in positioning the remote control levers 14L and 14R.

That is, the operator changes the shifts (i.e., forward, neutral, reverse) of the propulsion units 5L, 5M and 5R and adjusts the openings of the throttle valves 8*a* of the engines 6 by operating the remote controller 13 by manipulating the remote control levers 14L preferably and 14R to control the traveling speed of the vessel 1 and thrust for acceleration and deceleration. The left remote control lever 14L is provided for changing the shift of the left propulsion unit 5L and for adjustment of the opening of the throttle valve 8*a* (thrust control) of the left propulsion unit 5L. The right remote control lever 14R preferably is provided for changing the shift of the right propulsion unit 5R and for adjustment of the opening of the throttle valve 8*a* (thrust control) of the right propulsion unit 5R. Shift change of the center propulsion unit 5M and adjustment of the opening of the throttle valve 8*a* (thrust control) of the center propulsion unit 5M preferably is made based on an average position between the position of the left remote control lever 14L and the position of the right remote control lever 14R.

As shown in FIG. 2, when the two remote control levers 14L and 14R are in the center position, the shift is in neutral (N). When the remote control levers 14L and 14R are tilted to the front side from the center position, the shift changed to forward (F) shift. When the remote control levers 14L and 14R are tilted to the rear side from the center position, the shift is changed to reverse (R) shift. When the remote control levers 14L, and 14R are tilted further to the front side in the forward (F) shift range, the throttle valves 8*a* open gradually from F-full closed position to F-full open position. When the remote control levers 14L and 14R are tilted further to the rear side in the reverse (R) shift range, the throttle valves 8*a* open gradually from R-full closed position to R-full open position. The operator can therefore control thrust by opening and closing the throttle valves 8*a* both when the vessel is traveling forward and when it is traveling in reverse.

In the illustrated embodiment the remote controller 13 is connected to a remote control part 17L via a communication cable 16*a*1 and to remote control parts 17M and 17R via a communication cable 16*a*2. The remote control parts 17L, 17M and 17R preferably receive information on the lever positions of the remote control levers 14L and 14R outputted from the lever position sensors 15L and 15R, execute a prescribed operation on the lever position information and transmit it to engine control parts 18L, 18M and 18R of the three propulsion units 5L, 5M and 5R. The remote control part 17L and the engine control part 18L are connected via a communication cable 16*b*1, and the remote control parts 17M and 17R and the engine control parts 18M and 18R are connected via communication cables 16*b*2 and 16*b*3, respectively. In the illustrated propulsion units 5L, 5M and 5R, directional changes between forward and reverse and shift changes preferably are made by motor-operated shift mechanisms 19L, 19M and 19R attached to the engines 6.

On one side of the operator's seat 10 in the illustrated embodiment a main switch SWL, a main switch SWM and a main switch SWR are located at the left, center and right in the vicinity of the remote controller 13. The main switches SWL, SWM and SWR correspond to the propulsion units 5L, 5M and 5R, respectively, and the engines 6 of the propulsion units 5L, 5M and 5R are started by operating the main switches SWL, SWM and SWR, respectively. In addition, a steering drive device (not shown) for rotating the propulsion units about swivel shafts (not shown) thereof according to the operative position of the manual steering wheel 11 preferably is provided on the hull 2.

Figure 3:
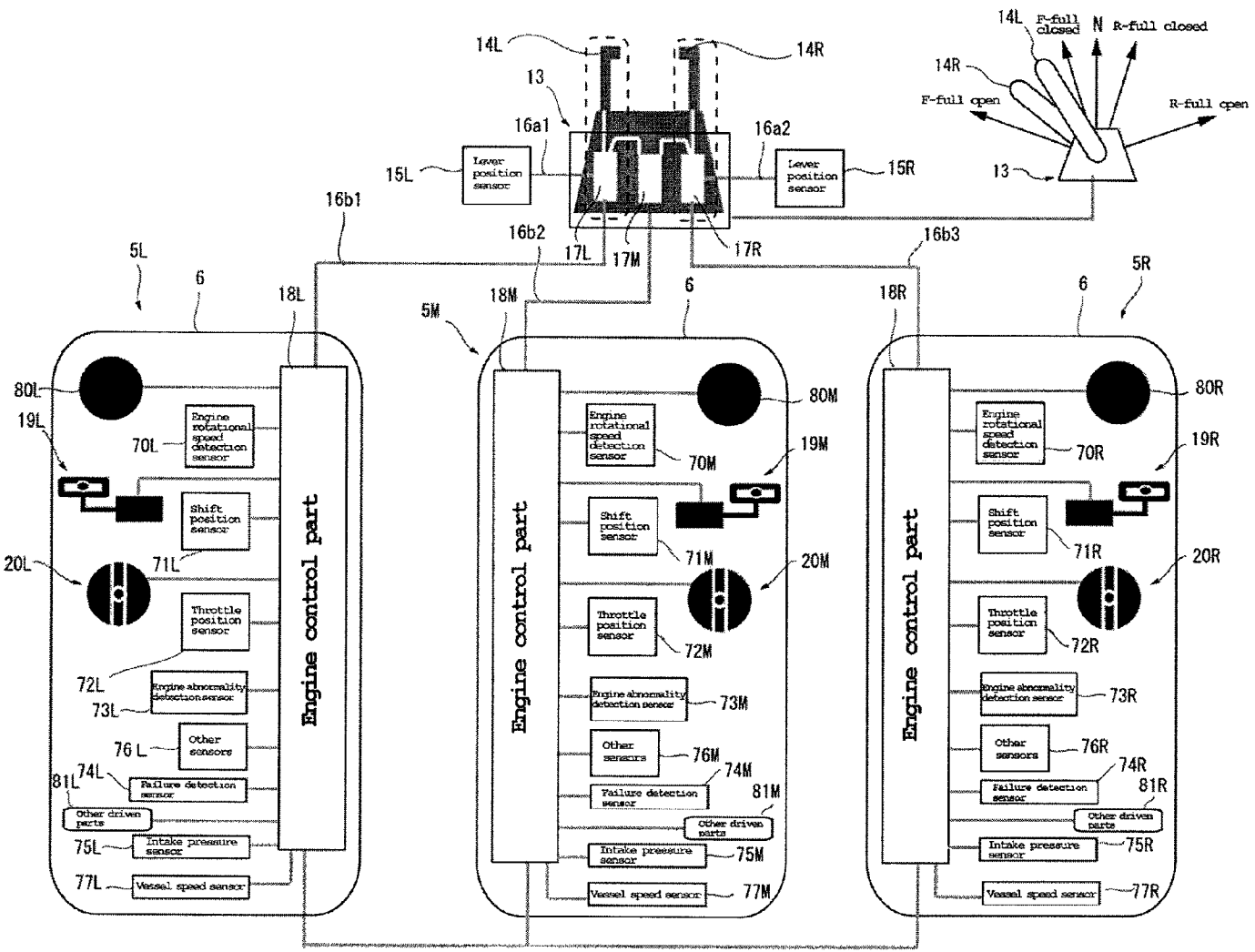
FIG. 3 is a system chart of one embodiment of a control device for plural propulsion units.

FIG. 3 is a system chart of the control device for propulsion units in accordance with one preferred embodiment. The engine control part 18L of the left propulsion unit 5L drives a flywheel 80L, the motor-operated shift mechanism 19L, the electronic throttle mechanism 20L, and other driven parts 81L. The engine control part 18L preferably includes an engine control unit (ECU), and the other driven parts 81L include an exhaust cam, an oil control valve and so on. To the engine control part 18L preferably are connected an engine rotational speed detection sensor 70L, a shift position sensor 71L, a throttle position sensor 72L, an engine abnormality detection sensor 73L, a failure detection sensor 74L, an intake pressure sensor 75L, a vessel speed sensor 77L, and other sensors 76L. The other sensors 76L preferably include, for example, a camshaft sensor, a thermosensor, and so on.

When the engine 6 is driven and the crankshaft rotates, the engine rotational speed detection sensor 70L obtains engine rotational speed information from rotation of the flywheel 80L mounted on the crankshaft and inputs it into the engine control part 18L. The shift position sensor 71L obtains information on the shift position (forward, reverse or neutral) from the drive of the motor-operated shift mechanism 19L and inputs it into the engine control part 18L. The throttle position sensor 72L obtains throttle opening information from the drive of the electronic throttle mechanism 20L and inputs it into the engine control part 18L. The engine abnormality detection sensor 73L detects engine abnormalities in the engine 6 of the left propulsion unit 5L such as overheat and a drop in engine oil level. The failure detection sensor 74L detects failures of the remote controller 13 of the vessel or the shift driving device, the throttle driving device and so on of the left propulsion unit 5L. The intake pressure sensor 75L detects the pressure in the air intake system of the engine 6 and can obtain load information based on the intake pressure information and the engine rotational speed information. The vessel speed sensor 77L, which preferably is located in water, obtains a voltage proportional to the resistance of the water and inputs it into the engine control part 18L.

The engine control part 18R of the right propulsion unit 5R drives a flywheel 80R, the motor-operated shift mechanism 19R, the electronic throttle mechanism 20R, and other driven parts 81R, and detection information is inputted into the engine control part 18R from the engine rotational speed detection sensor 70R, a shift position sensor 71R, a throttle position sensor 72R, an engine abnormality detection sensor 73R a failure detection sensor 74R, an intake pressure sensor 75R, a vessel speed sensor 77R, and other sensors 76R. The engine control part 18M of the center propulsion unit 5M drives a flywheel 80M, the motor-operated shift mechanism 19M, the electronic throttle mechanism 20M, and other driven parts 81M, and detection information is inputted into the engine control part 18M from the engine rotational speed detection sensor 70M, a shift position sensor 71M, a throttle position sensor 72M, an engine abnormality detection sensor 73M, a failure detection sensor 74M, an intake pressure sensor 75M, a vessel speed sensor 77M, and other sensors 76M. The engine control part 18R and the engine control part 18M, each of which preferably include engine control unit (ECU) just as the engine control part 18L, and the driven parts and the sensors of the engine control parts 18M and 18R, which preferably are constituted similarly to those of the engine control part 18L, transmit and receive obtained information.

The control device for propulsion units preferably operates the shift driving devices and the throttle driving devices in light of operation the two remote control levers 14L and 14R to synchronize the engine rotational speeds of the propulsion units. In one preferred embodiment, a control for the synchronization of the engine rotational speeds of the right propulsion unit 5R and the center propulsion unit 5M therewith is executed based on the engine rotational speed of the left propulsion unit 5L. Of course, other embodiment are contemplated. For example, a control for the synchronization of the engine rotational speeds of the left propulsion unit 5L and the center propulsion unit 5M therewith may be executed based on the engine rotational speed of the right propulsion unit 5R.

Additionally, a control for the synchronization of the engine rotational speed of the left propulsion unit 5L and the right propulsion unit 5R therewith may be executed based on the engine rotational speed of the center propulsion unit 5M. When the control device for the propulsion units is installed in the vessel, it preferably is determined which propulsion unit should be used as a reference and which propulsion units should be the targets of synchronization.

Figure 4:
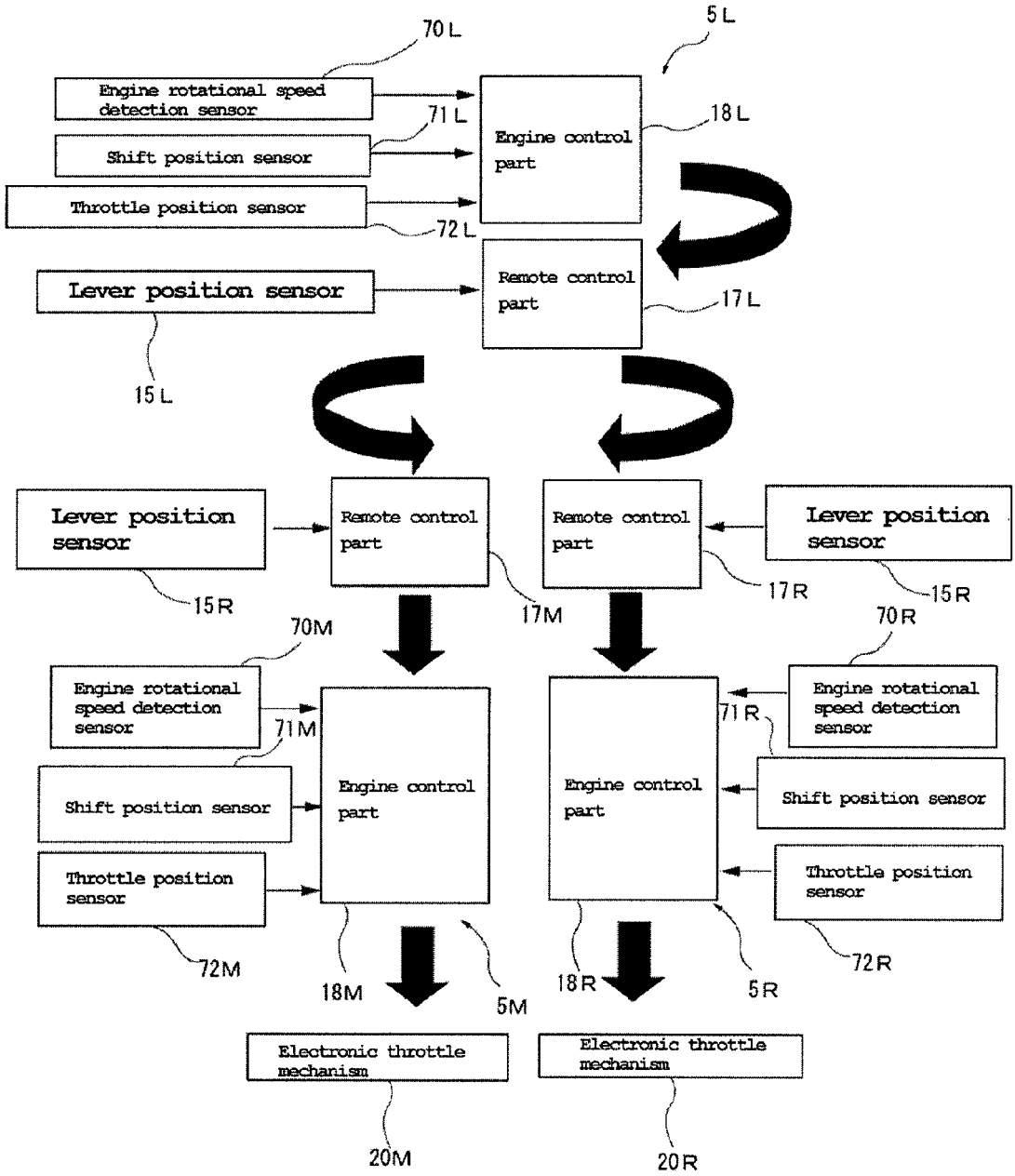
FIG. 4 is a schematic system chart of the control device of FIG. 3.
Figure 5:
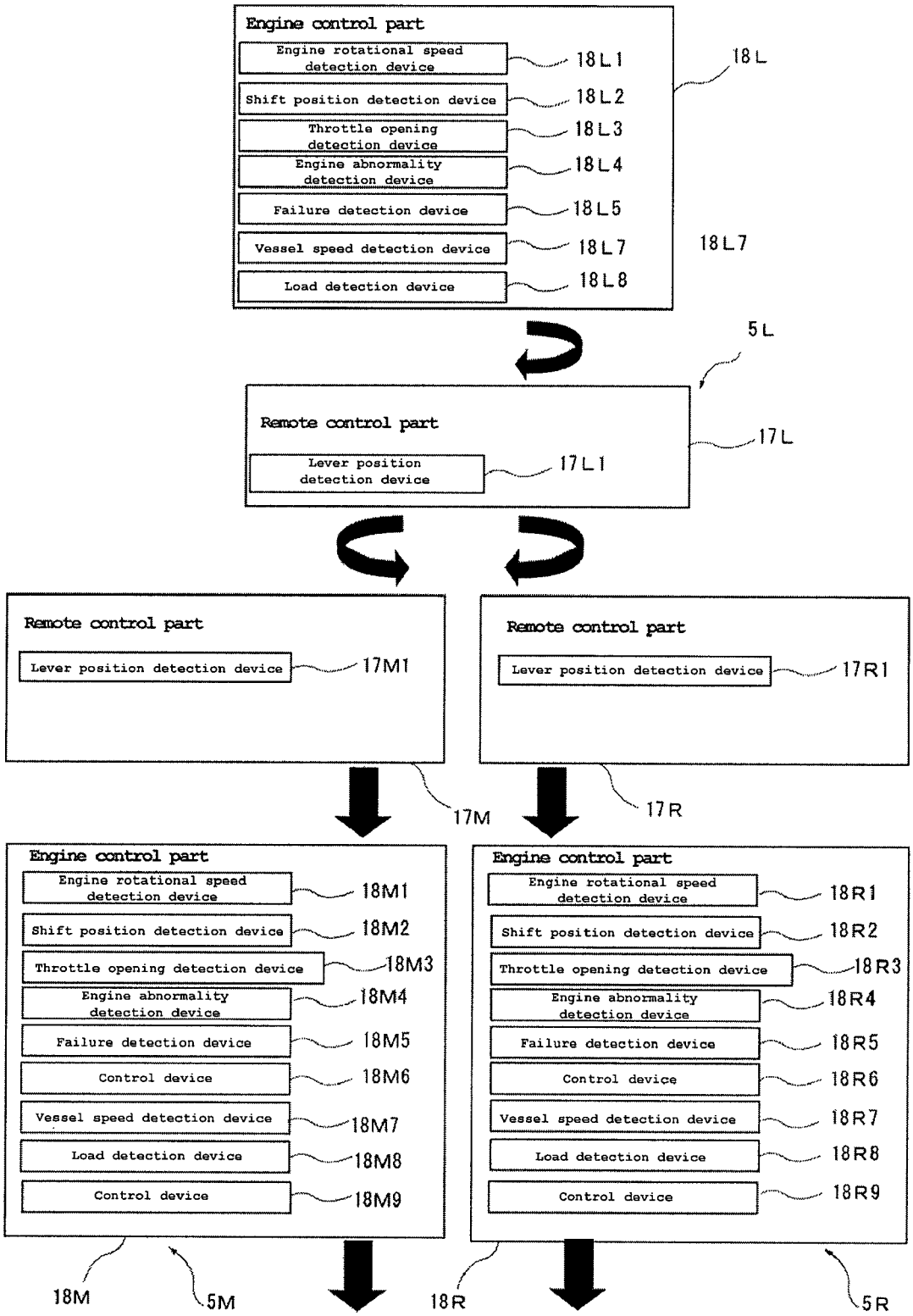
FIG. 5 is a view illustrating the configuration of the remote control parts and the engine control parts in accordance with an embodiment.
Figure 6:
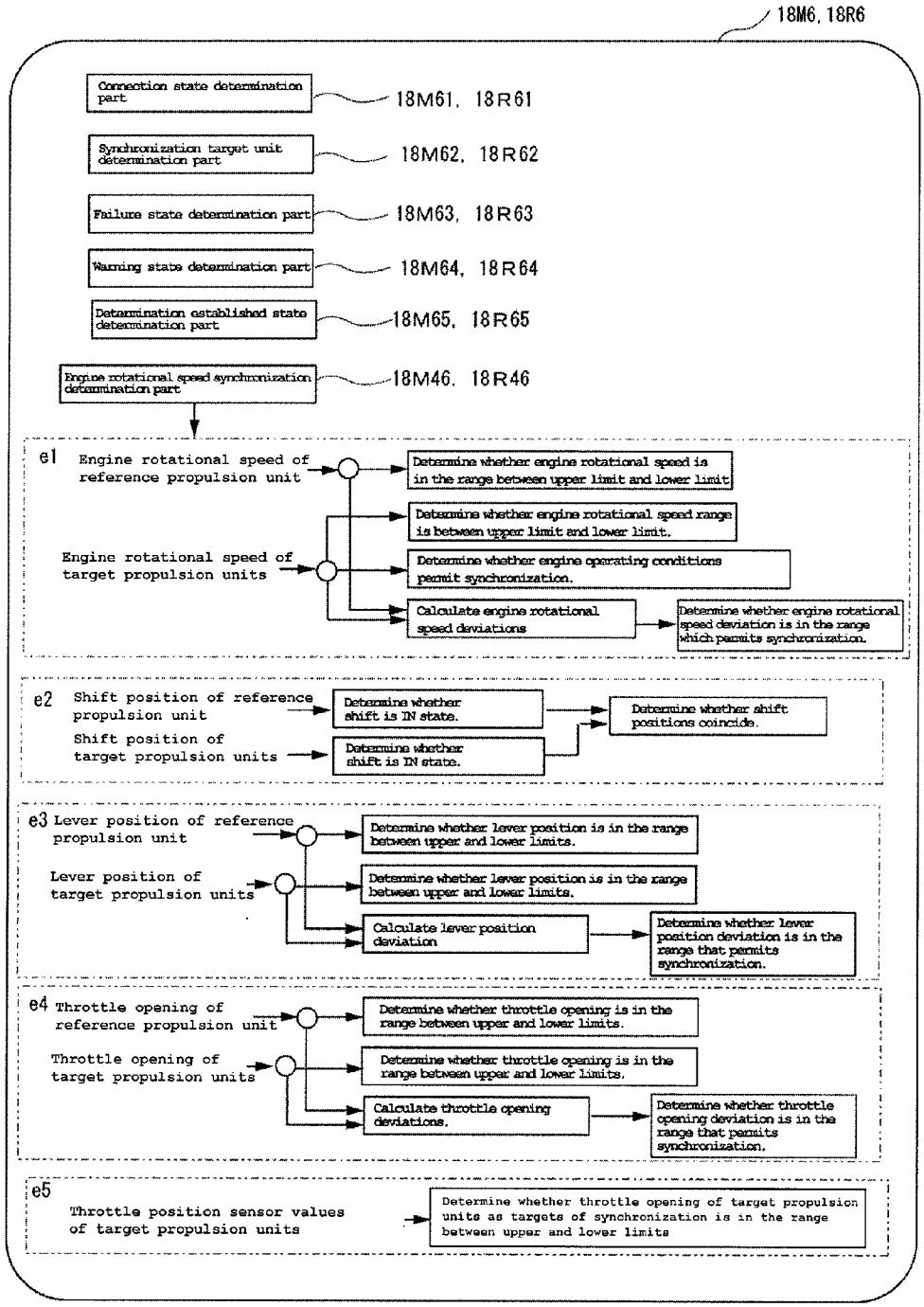
FIG. 6 is a view illustrating a rotation synchronizing control determination.
Figure 7:
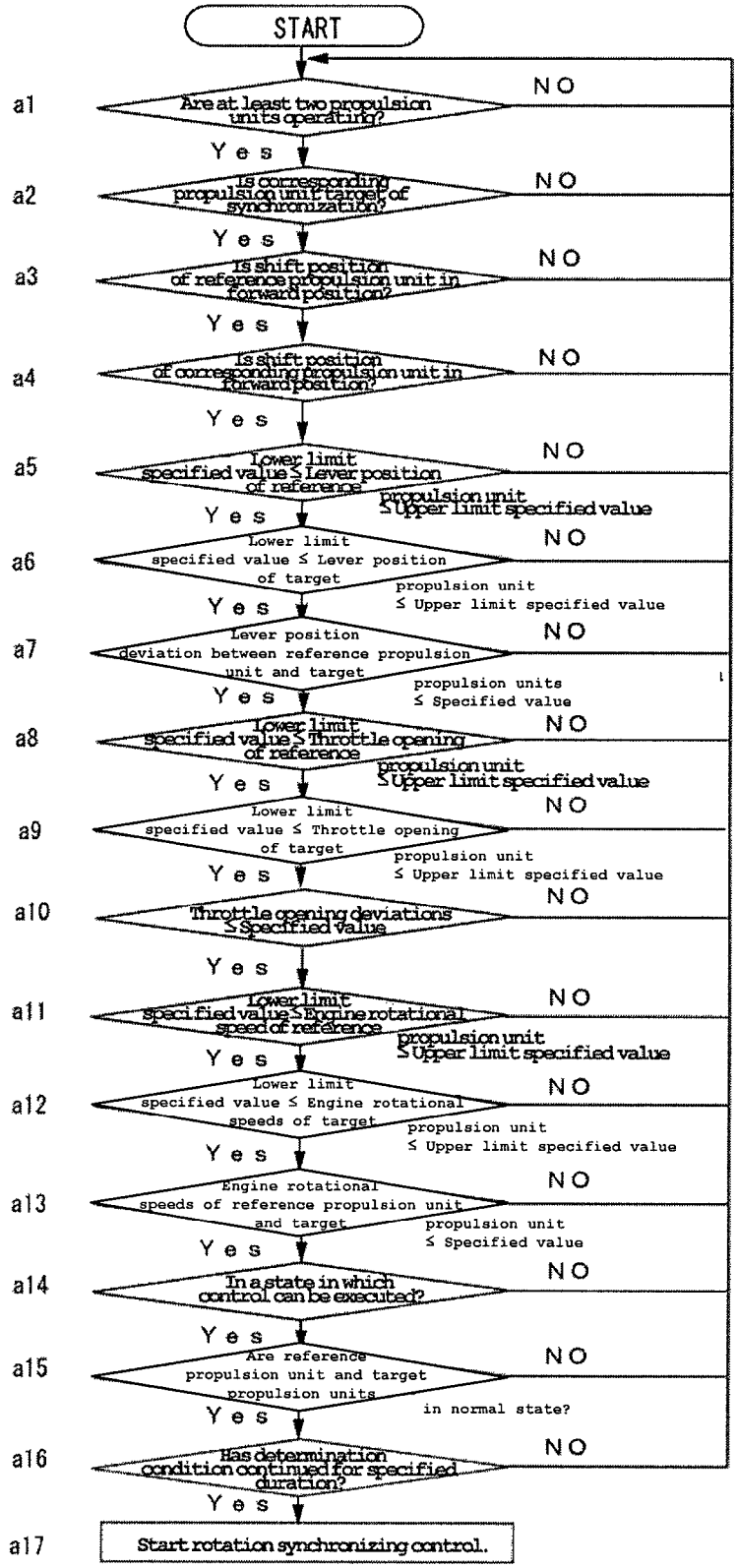
FIG. 7 is a flowchart of the rotation synchronizing control determination of FIG. 6.
Figure 8:
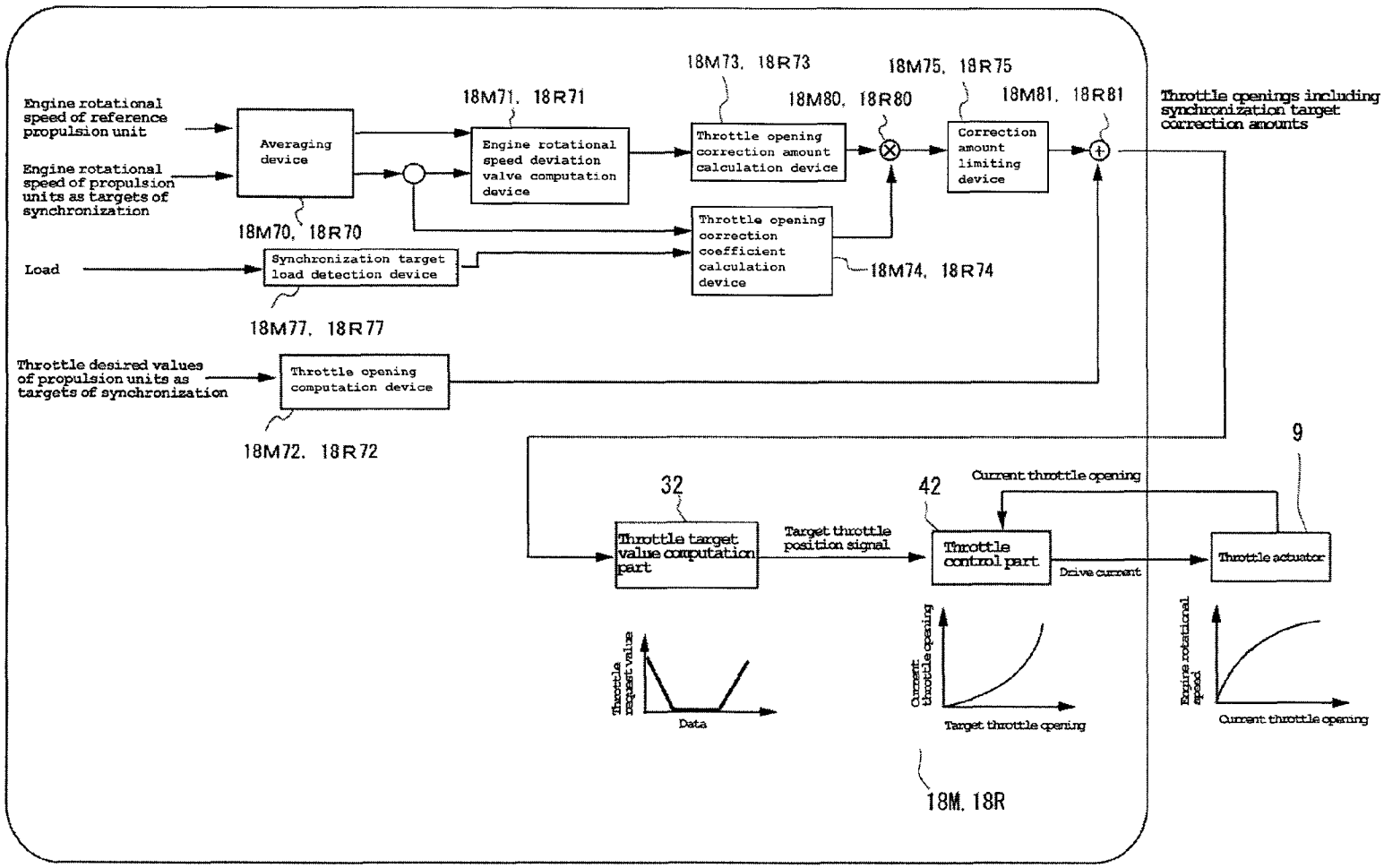
FIG. 8 is a block diagram of a rotation synchronizing control.

An embodiment of control for the synchronization of the engine rotational speeds of the propulsion units is described with reference to FIG. 4 to FIG. 8. FIG. 4 is a schematic system chart of the control device for propulsion units, FIG. 5 is a view illustrating the configuration of the remote control parts and the engine control parts, FIG. 6 is a view illustrating a rotation synchronizing control determination, FIG. 7 is a flowchart or the rotation synchronizing control determination, and FIG. 8 is a block diagram of a rotation synchronizing control.

With initial reference to FIG. 4, a lever position sensor value is inputted as a voltage value into the remote control part 17L of the reference propulsion unit 5L from the lever position sensor 15L. A lever position sensor value is also inputted as a voltage value from the lever position sensor 15R into the remote control parts 17M and 17R of the propulsion units 5M and 5R, which are the targets of synchronization (hereinafter "target propulsion units").

In a preferred embodiment, a sensor value is inputted as a pulse number into the engine control part 18L of the reference propulsion unit 5L from the engine rotational speed detection sensor 70L, and sensor values are inputted as voltage values into the engine control part 18L of the reference propulsion unit 5L from the shift position sensor 71L and the throttle position sensor 72L. Information obtained from the sensor values is transmitted to the remote control part 17L and then to the remote control parts 17M and 17R.

Sensor values preferably are also inputted into the engine control parts 18M and 18R of the target propulsion units 5M and 5R from the engine rotational speed detection sensors 70M and 70R, the shift position sensors 71M and 71R, and the throttle position sensors 72M and 72R, respectively. The engine control parts 18M and 18R drive the electronic throttle mechanisms 20M and 20R, respectively, based on information obtained from the sensor values and information transmitted to the remote control parts 17M and 17R.

The configuration of the remote control parts 17L, 17M and 17R and the engine control parts 18L, 18M and 18R is next described with reference to FIG. 5. The remote control part 17L of the reference propulsion unit 5L preferably has a lever position detection device 17L1. The lever position detection device 17L1 detects the lever position of the remote control lever 14L for the reference propulsion unit 5L based on a lever position sensor value from the remote control lever 14L. In this embodiment, a lever position is the angle by which the lever is tilted from the neutral position to the forward or reverse side. It is to be understood that, in other embodiments, an operating device such as joystick or slide volume can be used as the control lever. The lever position of the remote control lever 14L is the angle by which it is tilted from the neutral position to the forward or reverse side.

The engine control part 18L of the reference propulsion unit 5L in the illustrated embodiment has an engine rotational speed detection device 18L1, a shift position detection device 18L2, a throttle opening detection device 18L3, an engine abnormality detection device 18L4, a failure detection device 18L5, a vessel speed detection device 18L7, and a load detection device 18L8. The engine rotational speed detection device 18L1 obtains an engine rotational speed from a sensor value from the engine rotational speed detection sensor 70L, the shift position detection device 18L2 obtains a shift position from a sensor value from the shift position sensor 71L, and the throttle opening detection device 18L3 obtains a throttle opening from a sensor value of the throttle position sensor 72L. The engine abnormality detection device 18L4 detects engine abnormalities in the engine 6 of the propulsion unit 5L such as overheat or a drop in engine oil level based on a sensor signal from the engine abnormality detection sensor 73L of the reference propulsion unit 5L. The failure detection device 18L5 detects failures of the remote controller 13 of the vessel or the shift driving device, the throttle driving device and so on of the left propulsion unit 5L based on a sensor signal from the failure detection sensor 18L5. The vessel speed detection device 18L7 detects a vessel speed from a sensor value obtained from the vessel speed sensor 77L. The load detection device 18L8 obtains load information based on an engine rotational speed obtained from a sensor value from the engine rotational speed detection sensor 70L and intake pressure information from the intake pressure sensor 75L. The information on engine rotational speed, shift position, and throttle opening and the information on engine abnormalities, failures, vessel speed, and load are transmitted from the engine control part 18L to the remote control part 17L.

The remote control parts 17M and 17R of the target propulsion units 5M and 5R have lever position detection devices 17M1 and 17R1, respectively. The lever position detection device 17R1 detects the lever position of the remote control lever 14R for the target propulsion unit 5R. The lever position detection device 17M1 detects the middle position between the lever position of the remote control lever 14R for the target propulsion unit 5R and the lever position of the remote control lever 14L for the reference propulsion unit 5L. In this embodiment, a lever position is the angle by which the lever is tilted from the neutral position to the forward or reverse side. In other embodiments, an operating device such as joystick or slide volume can be used as the control lever. The information on the engine rotational speed, shift position, and throttle opening and the information on the engine abnormalities, failures, vessel speed, and load of the reference propulsion unit 5L is inputted from the remote control part 17L into the remote control parts 17M and 17R.

The engine control parts 18M and 18R of the target propulsion units 5M and 5R have engine rotational speed detection devices 18M1 and 18R1, shift position detection devices 18M2 and 18R2, throttle opening detection devices 18M3 and 18R3, engine abnormality detection devices 18M4 and 18R4, failure detection devices 18M5 and 18R5, vessel speed detection devices 18M7 and 18R7, and load detection devices 18M8 and 18R8, respectively. The engine rotational speed detection devices 18M1 and 18R1 obtain an engine rotational speed from a sensor value from the engine rotational speed detection sensor 70M and 70R, respectively, the shift position detection devices 18M2 and 18R2 obtain a shift position from a sensor value from the shift position sensors 71M and 71R, respectively, and the throttle opening detection devices 18M3 and 18R3 obtain a throttle opening from a sensor value from the throttle position sensors 72M and 72R, respectively. The engine abnormality detection devices 18M4 and 18R4 detect engine abnormalities in the engines 6 of the target propulsion units 5M and 5R such as overheat or a drop in engine oil level based on a sensor signal from the engine abnormality detection sensors 73M and 73R of the propulsion units 5M and 5R, respectively. The failure detection devices 18M5 and 18R5 detect failures of the remote controller 13 of the vessel or the shift driving device, the throttle driving device and so on of the propulsion units 5M and 5R based on a sensor signal from the failure detection sensors 74M and 74R, respectively. The vessel speed detection devices 18M7 and 18R7 detect a vessel speed from a sensor value obtained from the vessel speed sensors 77M and 77R, respectively. The load detection devices 18M8 and 18R8 obtain load information based on an engine rotational speed obtained from a sensor value from the engine rotational speed detection sensors 70M and 70R and intake pressure information from the intake pressure sensors 75M and 75R, respectively. The engine control parts 18M and 18R have control devices 18M6 and 18R6 and control devices 18M9 and 18R9, respectively. Information on lever position, shift position, throttle opening, engine rotational speed and so on of the reference propulsion unit 5L, and information on engine rotational speed, shift position, throttle opening and so on of the target propulsion units 5M and 5R are inputted into the control devices 18M6 and 18R6 and the control devices 18M9 and 18R9.

The configuration of the control devices 18M6 and 18R6 is described with reference to FIG. 6. The control devices 18M6 and 18R6, which are constituted similarly, execute the following determinations and execute a control for the synchronization of the engine rotational speeds of the propulsion units.

Connection state determination parts 18M61 and 18R61 determine whether the reference propulsion unit 5L is in a connected state based on information on lever position, shift position, throttle opening, engine rotational speed and so on of the reference propulsion unit 5L.

Synchronization target unit determination parts 18M62 and 18R62 determine whether the propulsion units 5M and 5R corresponding thereto are targets of synchronization based on information on lever position, shift position, throttle opening, engine rotational speed and so on thereof.

Since a protective control such as stopping the engines is executed based on a failure signal from failure detection device for detecting failures of the vessel or the propulsion units, failure state determination parts 18M63 and 18R63 determine the presence or absence of a protective control as a determination condition of a control for the synchronization of the engine rotational speeds, and the control for the synchronization of the engine rotational speeds of the propulsion units is executed when no protective control is executed. When a sensor or actuator in systems of the propulsion units has a failure, it not only makes the rotation synchronizing control impossible but also may cause unintentional behavior. Thus, a protective control for systems of a plurality of propulsion units is determined as a determination condition of the rotation synchronizing control to achieve a safe and stable rotation synchronizing control.

Since a warning control such as decreasing the engine rotational speeds is executed based on detection of an engine abnormality based on an abnormality signal from the engine abnormality detection device for detecting engine abnormalities of the propulsion units, warning state determination parts 18M64 and 18R64 determine the presence or absence of a warning control as a determination condition, and the control for the synchronization of the engine rotational speeds of the propulsion units is not executed when a warning control is executed. Since the presence or absence of a warning control is determined as a determination condition, and the control for the synchronization of the engine rotational speeds of the propulsion units is not executed when a warning control is executed as described above, the vessel is slowed down to protect the engines when a warning of overheat or a drop in hydraulic pressure is provided. The presence or absence of a warning control is determined as a determination condition of a rotation synchronizing control to protect the engines when a warning is provided.

In some embodiments, established state determination parts 18M65 and 18R65 determine the duration for which the determination conditions have continued as an execution condition of the control for the synchronization of the engine rotational speeds. When the determination conditions have continued for a prescribed duration, the control for the synchronization of the engine rotational speeds of the propulsion units is executed. In the environment in which the propulsion units are used, the load conditions are changed by various factors such as waves and tides, and the determination conditions may sometimes be satisfied for only a moment. Thus, the duration for which the determination conditions have continued is determined as an execution condition of the control for the synchronization of the engine rotational speeds, and the control for the synchronization of the engine rotational speeds is executed when the determination conditions have continued for a prescribed duration. This is conducive to achieving a stable rotation synchronizing control.

The execution condition is set based on the lever positions of the control levers, and the control for the synchronization of the engine rotational speeds of the propulsion units is executed when the lever positions are beyond a specified position. When a vessel having a plurality of propulsion units is steered, especially in a low speed condition, the control levers are thought to be operated frequently to change directions or make turns during traveling at a low speed. However, the operator usually wants to synchronize the engine rotational speeds quickly and precisely when speeds are in the cruising range. Thus, in some embodiments a specified duration as a determination condition is set long when the lever position, that is, the lever angle, is small and the engine rotational speed is low (for example, when the lever angle is 10° to 20° and the engine rotational speed is 3000 rpm or lower), and the specified duration is set short when the lever angle is large and the engine rotational speed is in the cruising range (for example, when the lever angle is 20° or larger and the engine rotational speed is 3000 rpm to 5000 rpm). Since an execution condition is set based on the lever positions of the control levers and the control for the synchronization of the engine rotational speeds of the propulsion units is executed when the lever positions are beyond a specified position as described above, a rotation synchronizing control in accordance with the steering intention of the operator can be achieved.

Engine rotational speed synchronization determination parts 18M46 and 18R46 make a determination to execute the control for the synchronization of the engine rotational speeds of the propulsion units as described below, and with reference to FIG. 6.

In step e1, it is determined whether the engine rotational speed of the reference propulsion unit 5L is in the range between an upper limit rotational speed and a lower limit rotational speed, and it is determined whether the engine rotational speeds of the target propulsion units 5M and 5R are in the range between the upper limit rotational speed and the lower limit rotational speed. For example, in one embodiment the upper limit rotational speed and the lower limit rotational speed of the engine rotational speeds are 6000 rpm and 500 rpm, respectively. As described above, the upper limit rotational speed of the engine rotational speed of one of the propulsion units is determined as a determination condition, and, when the engine rotational speeds are equal to or lower than the upper limit rotational speed, the control for the synchronization of the engine rotational speeds of the propulsion units is allowed.

Also, the lower limit rotational speed of the engine rotational speed of one of the propulsion units is determined as a determination condition, and, when the engine rotational speed is equal to or higher than the lower limit rotational speed, the control for the synchronization of the engine rotational speeds of the propulsion units is allowed.

Also, it is determined, based on the engine rotational speeds of the propulsion units 5M and 5R as targets of synchronization, whether the operating conditions of the engines permit the control for the synchronization of the engine rotational speeds to be executed. If the conditions permit, the control for the synchronization of the engine rotational speeds of the propulsion units is allowed.

Also, deviations in engine rotational speed are calculated from the engine rotational speed of the reference propulsion unit 5L, and the engine rotational speeds of the target propulsion units 5M and 5R, and it is determined whether the deviations in engine rotational speed are in a deviation range of engine rotational speed which permits synchronization. When the deviations are in the deviation range, the control for the synchronization of the engine rotational speeds of the propulsion units is allowed.

The upper limit rotational speeds of the engine rotational speeds may differ because of the variation in engine rotational speed or variation in load due to the difference in installation positions of a plurality of propulsion units. When the upper limit rotational speed as a reference is lowest in those of a plurality of propulsion units and the engine rotational speeds are synchronized based on it, the total output is suppressed. Thus, in one embodiment the upper limit rotational speed of the engine rotational speed of one of the propulsion units is determined as a determination condition of the control for synchronization, and the control for the synchronization of the engine rotational speeds of the propulsion units is executed when the engine rotational speed are equal to or lower than the upper limit rotational speed. An upper limit rotational speed for the rotation synchronizing control is set to increase the total output of a plurality of propulsion units. The upper limit rotational speed of the engine rotational speeds of the propulsion units is, for example, 6000 rpm.

In engine control at a time when the throttle openings are small, a control for achieving an idle rotational speed by correction of throttle opening and/or ignition timing is executed. Thus, when the lower limit rotational speed of the engine rotational speed of one of the propulsion units is determined as a determination condition, a control for the synchronization of the engine rotational speeds of the propulsion units is executed when the engine rotational speeds are equal to or lower than the lower limit rotational speed, and a lower limit rotational speed for a rotation synchronizing control is determined to select a control suitable for the operating speed so that control for the idle rotational speed and a rotation synchronizing control cannot be executed simultaneously, stable rotations of the engines can be achieved. The lower limit rotational speed of the engine rotational speeds of the propulsion units is, for example, 500 rpm.

In step e2, based on the shift position of the control lever for the reference propulsion unit, the shift input state thereof is determined, and, based on the shift position of the control lever for the target propulsion units, the shift input state thereof is determined. If they are in an input state, it is determined whether their shift positions coincide with each other as a determination condition of a control for the synchronization of the engine rotational speeds. If the shift positions coincide with each other, the control for the synchronization of the engine rotational speeds of the propulsion units is allowed. When the shift positions of a plurality of propulsion units are different, the load conditions are different, which makes rotation synchronization difficult and does not meet the intention to achieve smooth cruising. Thus, coincidence of the shift positions preferably is determined as a determination condition, and the control for the synchronization of the engine rotational speeds of the propulsion units is executed when the shift positions coincide with each other to carry out a rotation synchronizing control in accordance with the intention of the operator to synchronize the engine rotational speeds of a plurality of propulsion units.

In step e3, it is determined whether the lever position of the control lever for the reference propulsion unit 5L is in the range between an upper limit position and a lower limit position, and it is determined whether the lever position of the control lever for the target propulsion units 5M and 5R is in the range between the upper limit position and the lower limit position. The upper limit position of the lever position of the control lever for one of the propulsion units is determined as a determination condition, and a control for the synchronization of the engine rotational speeds of the propulsion units is allowed when the lever position is not beyond the upper limit position.

Also, the lower limit position of the lever position of the control lever for one of the propulsion units is determined as a determination condition of the control for synchronization, and a control for the synchronization of the engine rotational speeds of the propulsion units is allowed when the lever position is in or beyond the upper limit position.

Also, a deviation between the lever position of the control lever for the reference propulsion unit and the lever position of the control lever for the target propulsion units preferably is computed as a determination condition of control for the synchronization of the engine rotational speeds. When the deviation in lever position is equal to or smaller than a specified value, the control for the synchronization of the engine rotational speeds of the propulsion units is allowed. The deviation value between lever positions is, for example, 5° in one preferred embodiment. The deviation in lever position is determined as a determination condition of a control for the synchronization of the engine rotational speeds. By evaluating the deviation it is determined whether the control levers for a plurality of propulsion units are in substantially the same position, and a control for the synchronization of the engine rotational speeds of the propulsion units is executed when the deviation is equal to or smaller than a specified value as described above to carry out a rotation synchronizing control in accordance with the intention of the operator to synchronize the engine rotational speeds of a plurality of propulsion units.

In step e4, it is determined whether the throttle opening of the reference propulsion unit is in the range between an upper limit and a lower limit and whether the throttle openings of the target propulsion units are in the range between the upper limit and the lower limit as a determination condition of a control for synchronizing the engine rotational speeds, and a control for synchronizing the engine rotational speeds of the propulsion units is allowed.

Also, deviations between the throttle opening of the reference propulsion unit and the throttle openings of the target propulsion units are computed as a determination condition of a control for the synchronization of the engine rotational speeds. When the deviations are equal to or smaller than a specified value, the control for the synchronization of the engine rotational speeds of the propulsion units is allowed.

The deviations in throttle opening are, for example, 5° in one embodiment. The deviations in throttle opening as a determination condition of a control for the synchronization of the engine rotational speeds are determined based on the throttle openings for air amount adjustment to determine the outputs of the propulsion units, and a control for the synchronization of the engine rotational speeds of the propulsion units is executed when the deviations are equal to or smaller than a specified value as described above to carry out a stable rotation synchronizing control for the synchronization of the engine rotational speeds of a plurality of propulsion units.

In step e5, it is determined whether throttle openings obtained from throttle position sensor values of the target propulsion units are in the range between an upper limit and a lower limit. The throttle openings of the target propulsion units are determined as a determination condition of a control for the synchronization of engine rotational speeds, and a control for the synchronization of the engine rotational speeds of the propulsion units is allowed.

The flowchart of rotation synchronizing control determination shown in FIG. 7 is next described.

In step a1, the control devices 18M4 and 18R4 of the target propulsion units 5M and 5R determine whether the reference propulsion unit 5L is in a connected state based on information about the reference propulsion unit 5L such as lever position, shift position, throttle opening, and engine rotational speed to determine whether at least two propulsion units are operating.

In step a2, if at least two propulsion units are operating, it is determined whether its corresponding propulsion unit is the target propulsion unit 5M or the target propulsion unit 5R.

In step a3, it is determined whether the shift position of the reference propulsion unit 5L is in the forward position if its corresponding propulsion unit is the target propulsion unit 5M or the target propulsion unit 5R.

In step a4, if the shift position of the reference propulsion unit 5L, is in the forward position, it is determined whether the shift position of its corresponding target propulsion unit 5M or 5R is in the forward position.

In step a5, it is determined whether the lever position of the reference propulsion unit 5L is in the range between a lower limit specified value and an upper limit specified value if the shift position of its corresponding target propulsion unit 5M or 5R is in the forward position.

In step a6, if the lever position of the reference propulsion unit 5L is in the range between a lower limit specified value and an upper limit specified value, it is determined whether the lever position of the target propulsion units 5M and 5R is in the range between a lower limit specified value and an upper limit specified value.

In step a7, if the lever position of the target propulsion units 5M and 5R is in the range between a lower limit specified value and an upper limit specified value, it is determined whether the deviation between the lever position of the reference propulsion unit 5L and the lever positions of the target propulsion units 5M and 5R is equal to or smaller than a specified value.

In step a8, if the deviation in lever position is equal to or smaller than a specified value, it is determined whether the throttle opening of the reference propulsion unit 5L is in the range between a lower limit specified value and an upper limit specified value.

In step a9, if the throttle opening of the reference propulsion unit 5L is in the range between a lower limit specified value and an upper limit specified value, it is determined whether the throttle openings of the target propulsion units 5M and 5R are in the range between a lower limit specified value and an upper limit specified value.

In step a10, if the throttle openings of the target propulsion units 5M and 5R are in the range between a lower limit specified value and an upper limit specified value, it is determined whether the deviations in throttle opening are equal to or smaller than a specified value.

In step a11, if the deviations in throttle opening are equal to or smaller than a specified value, it is determined whether the engine rotational speed of the reference propulsion unit 5L is in the range between a lower limit rotational speed and an upper limit rotational speed.

In step a12, if the engine rotational speed of the reference propulsion unit 5L is in the range between a lower limit rotational speed and an upper limit rotational speed, it is determined whether the engine rotational speeds of the target propulsion units 5M and 5R are in the range between a lower limit rotational speed and an upper limit rotational speed.

In step a13, if the engine rotational speeds of the target propulsion units 5M and 5R are in the range between a lower limit rotational speed and an upper limit rotational speed, it is determined whether the deviations in engine rotational speed are equal to or smaller than a specified value.

In step a14, if the deviations in engine rotational speed are equal to or smaller than a specified value, the presence or absence of a warning control in each propulsion unit is determined as a determination condition, and, when a warning control is executed, the control for the synchronization of the engine rotational speeds of the propulsion units is not executed.

In step a15, a protective control is executed based on failure signals from the failure detection device for detecting failures of the vessel or each propulsion unit, and the presence or absence of a protective control is determined as a determination condition. When a protective control is not executed, the control for the synchronization of the engine rotational speeds of the propulsion units is executed.

In step a16, the duration for which the determination condition has continued is determined as an execution condition of a control for the synchronization of the engine rotational speed. When the determination condition has continued for a specified duration, a control for the synchronization of the engine rotational speeds is executed.

In step a17, if the determination condition has continued for a specified duration, a control for the synchronization of the engine rotational speeds is executed.

Figure 9:
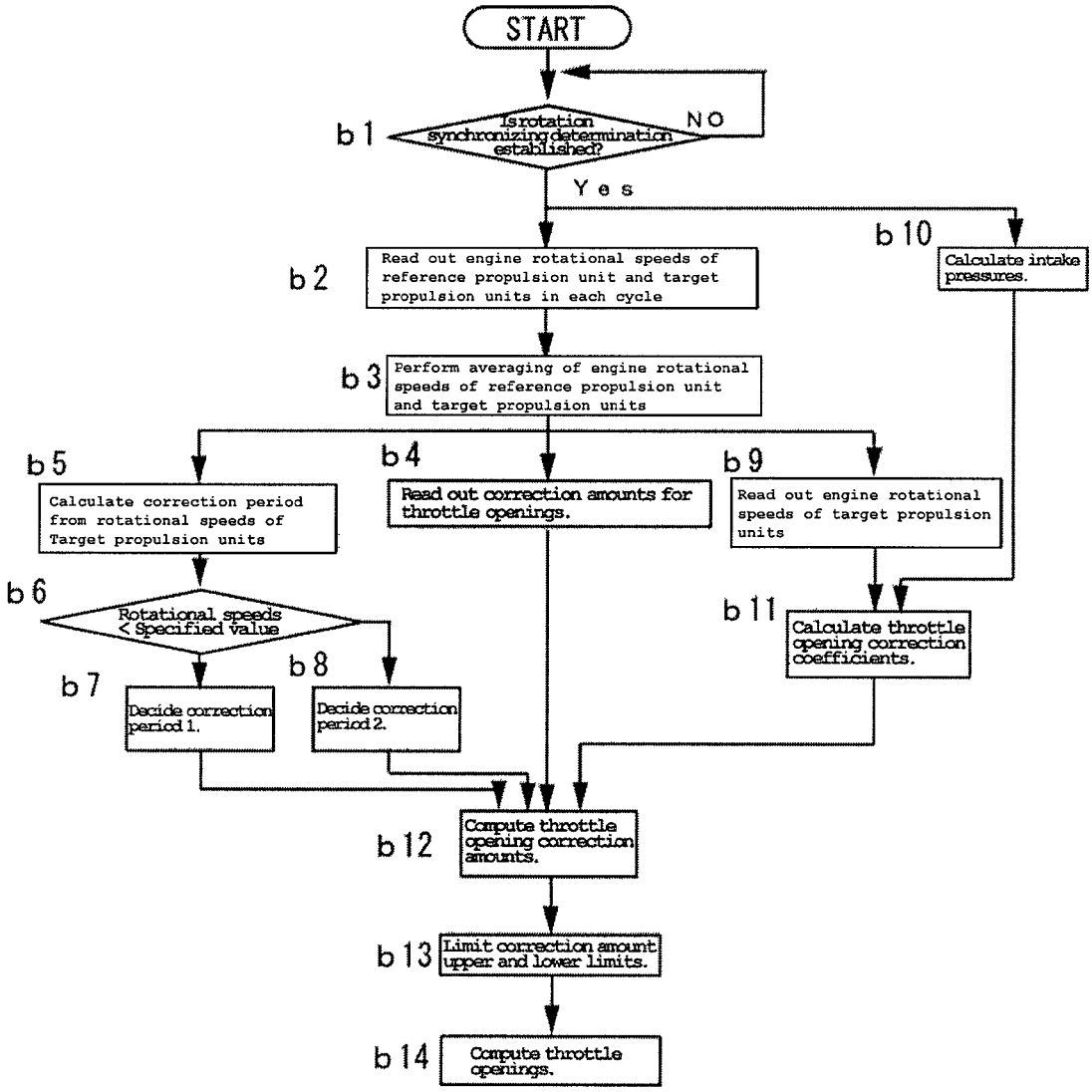
FIG. 9 is a flowchart of the rotation synchronizing control of FIG. 8.
Figure 10:
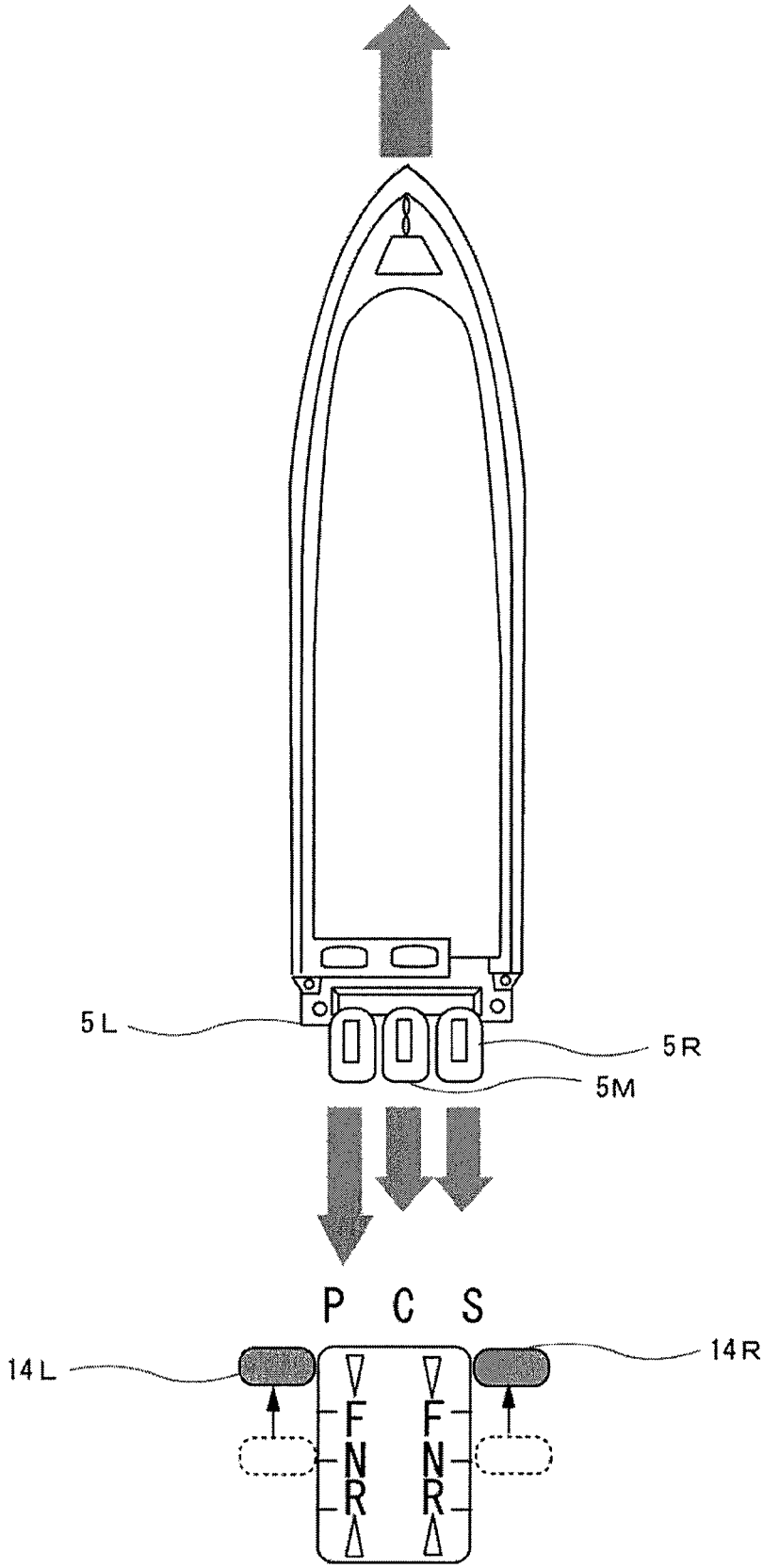
FIG. 10 is a view illustrating a state in which the load of the reference propulsion unit is low.
Figure 11:
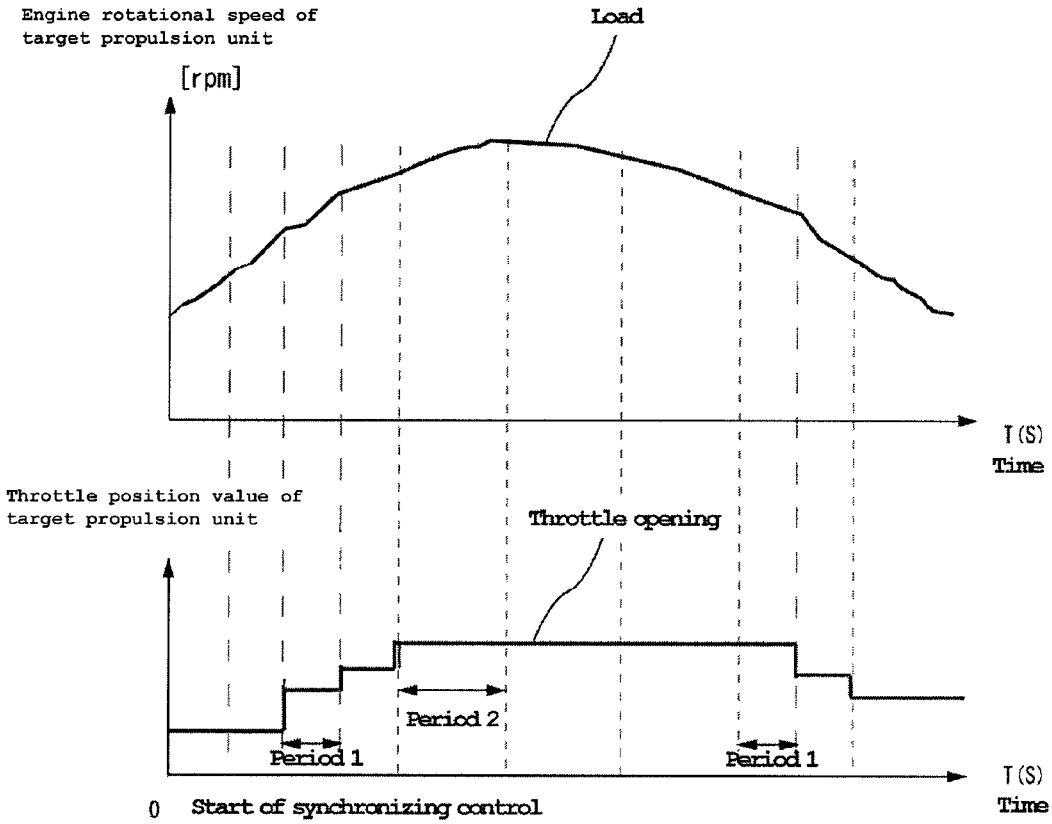
FIG. 11 is a view illustrating the state in which the correction period and correction coefficient vary depending on load conditions.
Figure 12:
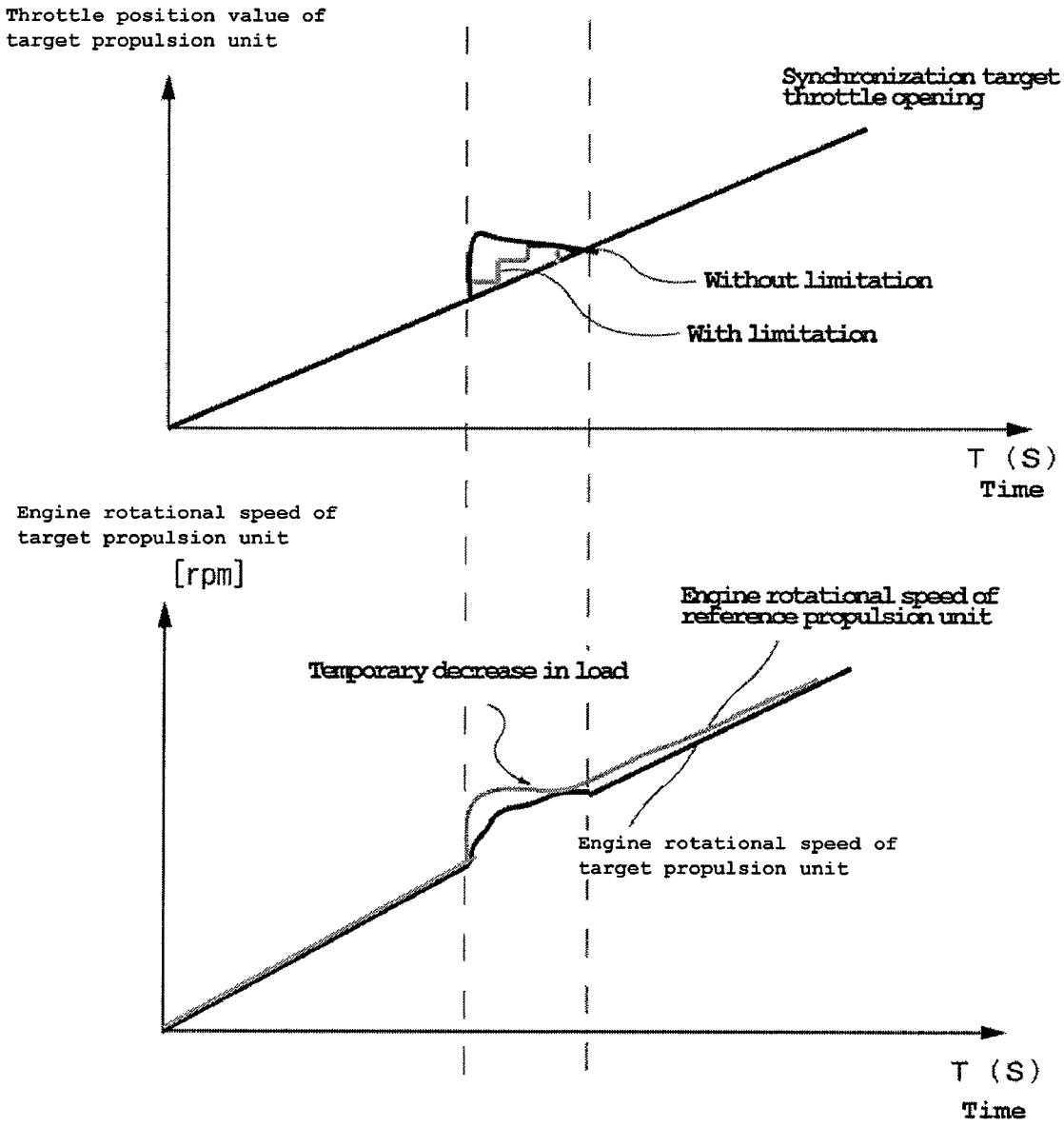
FIG. 12 is a view illustrating a throttle opening correction limitation.

The control for the synchronization of the engine rotational speeds of the propulsion units is described with reference to FIG. 8 to FIG. 12. FIG. 8 is a block diagram of the rotation synchronizing control, FIG. 9 is a flowchart of the rotation synchronizing control, FIG. 10 is a view illustrating a state in which the load of the reference propulsion unit is low, FIG. 11 is a view illustrating the state in which the correction period and correction coefficient vary depending on load conditions, and FIG. 12 is a view illustrating a throttle opening correction limitation.

An example in which a target position of the engine control for the target propulsion units 5M and 5R is set is described below with reference to FIG. 8. The control devices 18M6 and 18R6 provided in the engine control parts 18M and 18R of the target propulsion units 5M and 5R have averaging devices 18M70 and 18R70 and engine rotational speed deviation value computation devices 18M71 and 18R71, respectively. The averaging devices 18M70 and 18R70 perform an averaging process on the engine rotational speed of the reference propulsion unit 5L, and the engine rotational speeds of the target propulsion units 5M and 5R, respectively. In the illustrated embodiment the averaging devices 18M70 and 18R70 perform an averaging process as follows: the engine rotational speed (n−1) of the reference propulsion unit 5L in the previous cycle×K+the current engine rotational speed (n) of the reference propulsion unit 5L×(1−K). In the averaging process, the previous value (in the previous cycle) and the current value are equally weighted by setting K to, for example, 0.5 to reduce small rotational fluctuations. Also, the averaging devices 18M70 and 18R70 performs an averaging process as follows: the engine rotational speeds (n−1) of the target propulsion units 5M and 5R in the previous cycle×K+the current engine rotational speeds (n) of the target propulsion units 5M and 5R×(1−K). In the averaging process, the current value is weighted more heavily by setting K to 0.02 to achieve synchronization with the engine rotational speed of the reference propulsion unit 5L quickly.

The engine rotational speed deviation value computation devices 18M71 and 18R71 compute the deviations between the averaged engine rotational speed of the reference propulsion unit 5L and the averaged engine rotational speeds of the target propulsion units 5M and 5R so that the control for the synchronization of the engine rotational speeds can be executed smoothly even when the engine rotational speeds are changed because, for example, of a change in the load of the reference propulsion unit 5R or the target propulsion units 5M and 5R.

The control devices 18M6 and 18R6 have throttle opening computation devices 18M72 and 18R72, throttle opening correction amount calculation devices 18M73 and 18R73, throttle opening correction coefficient calculation devices 18M74 and 18R74, correction amount limitation devices 18M75 and 18R75, and synchronization target load detection devices 18M77 and 18R77, respectively.

The throttle opening computation devices 18M72 and 18R72 compute throttle openings based on throttle opening desired values of the propulsion units 5M and 5R as targets of synchronization. The throttle opening correction amount calculation devices 18M73 and 18R73 calculate throttle opening correction amounts from the deviations between the engine rotational speed of the reference propulsion unit 5L and the engine rotational speeds of the target propulsion units 5M and 5R. The throttle opening correction coefficient calculation devices 18M74 and 18R74 calculate correction coefficients from a correction coefficient map value suitable for the load conditions as shown in FIG. 11 based on loads of the target propulsion units from the synchronization target load detection devices 18M77 and 18R77 and the averaged engine rotational speeds. In computation parts 18M80 and 18R80, the throttle opening correction amounts are corrected based on the correction coefficients. When the corrections of the throttle openings in the correction amount limitation devices 18M75 and 18R75 are in the range between a lower limit value and an upper limit value, the throttle opening desired values of the target propulsion units 5M and 5R are corrected based on the throttle opening correction amounts in the computation part 18M81 and 18R81 to obtain throttle openings including synchronization target correction amounts.

Data of throttle openings including the synchronization target correction amounts are inputted into a throttle target value computation part 32, throttle request values of the propulsion units 5M and 5R corresponding to the data are computed therein, and a target throttle position signal is outputted therefrom. A throttle control part 42 compares current throttle opening information based on feedback signals provided as feedbacks from electronic throttles (that is, the motors 9) of throttle actuators and target throttle opening information from the throttle target value computation part 32, and outputs a target throttle opening signal so as to achieve target throttle openings. A drive current is thereby outputted so as to achieve the target throttle openings, and the electronic throttles (that is, the motors 9) of the throttle actuators are driven to achieve a prescribed engine rotational speed.

An embodiment of the rotation synchronizing control is next described with reference to the flowchart of the rotation synchronizing control shown in FIG. 9.

In step b1, it is determined whether a rotation synchronizing determination described in connection with FIG. 1 to FIG. 7 is established.

In step b2, if the rotation synchronizing determination is established, the engine rotational speeds of the reference propulsion unit 5L and the target propulsion units 5M and 5R are read out in each cycle.

In step b3, the engine rotational speeds of the reference propulsion unit 5L and the engine rotational speed of the target propulsion units 5M and 5R are subjected to an averaging process.

In step b4, deviations in averaged engine rotational speed are computed, and correction amounts for throttle openings are calculated from the deviations and read out.

In step b5, a period of correction is calculated from the averaged engine rotational speeds of the target propulsion units 5M and 5R.

In step b6, it is determined whether the engine rotational speeds of the target propulsion units 5M and 5R are equal to or lower than a specified value.

In step b7, if the engine rotational speeds of the target propulsion units 5M and 5R are equal to or lower than the specified value, a short correction period 1 as shown in FIG. 11 is decided.

In step b8, if the engine rotational speeds of the target propulsion units 5M and 5R are equal to or higher than the specified value, a long correction period 2 is decided. The correction period 2 is a time period shorter than the correction period 1.

In step b9, engine rotational speeds of the target propulsion units 5M and 5R are read out.

In step b10, intake pressure information is obtained by calculation from sensor values obtained from the intake pressure sensors 75M and 75R of the target propulsion units 5M and 5R.

In step b11, the synchronization target load detection devices 18M77 and 18R77 obtain load information from a synchronization target engine rotational speed and the intake pressures, and calculate throttle opening correction coefficients based on the load information.

In step b12, throttle opening correction amounts are computed based on the throttle opening correction amounts and throttle opening correction coefficients of correction coefficient map values suitable for the load conditions in the correction period 1 or the correction period 2 as shown in FIG. 11.

In step b13, the upper and lower limits of the throttle opening correction amounts for the target propulsion units 5M and 5R obtained in step b12 are limited.

In step b14, the throttle opening desired values of the target propulsion units 5M and 5R are corrected based on the throttle opening correction amounts to obtain throttle openings including the synchronization target correction amounts.

As described above, based on deviations in engine rotational speed throttle openings of the target propulsion units 5M and 5R are obtained by correction, and the engine rotational speeds of the target propulsion units 5M and 5R are synchronized with the engine rotational speed of the reference propulsion unit 5R. Since a control for the synchronization of the engine rotational speeds of the propulsion units 5R, 5M and 5R is carried out and the throttle openings are changed depending on the deviations in engine rotational speed, the engine rotational speeds can be automatically converged to and synchronized with a desired engine rotational speed quickly and reliably.

Even when the loads of the target propulsion units 5M and 5R are low as shown in FIG. 10, when the remote control levers 14L and 14R are operated in the same way, the engine rotational speeds of the target propulsion units can be automatically converged and synchronized with the engine rotational speed of the reference propulsion unit by driving the shift driving devices and the throttle driving devices thereof.

The loads may vary depending on waves or tides, or the type of the hull or propellers as shown in FIG. 11. Therefore, a correction period suitable for the load conditions is set based on the loads of the target propulsion units 5M and 5R and correction coefficient map values suitable for the load conditions are set. Then, the throttle openings of the target propulsion units 5M and 5R are obtained by correction based on the correction period and the correction coefficient map values, and a control for the synchronization of the engine rotational speeds of the propulsion units is executed. As described above, even when the loads vary depending on the waves or tides, or the type of hull or propellers, since the throttle openings are corrected and the engine rotational speed of the target propulsion units 5M and 5R are synchronized with the engine rotational speed of the reference propulsion unit 5L, the engine rotational speeds can be converged to and synchronized with a desired engine rotational speed quickly and reliably.

Also, periods of correction of the throttle openings, for example, the period 1 and the period 2, preferably are decided based on the loads obtained from the engine rotational speeds and intake pressures of the propulsion units as targets of synchronization, and a control for the synchronization of the engine rotational speeds of the propulsion units is executed with the short period 1 when the engine rotational speeds are low and with the long period 2 when engine rotational speeds are high. Since the period of correction of the throttle openings is changed as described above, even when the period of rotational fluctuations of the engine rotational speeds is changed because of a change in load from an intermediate-speed rotation range to a high-speed rotation range, for example, it is possible to execute a stable control for the synchronization of the engine rotational speeds to make the engine rotational speeds follow the target engine rotational speed.

Also, a control for the synchronization of the engine rotational speed of the target propulsion units 5M and 5R with that of the reference propulsion unit 5R is executed when correction of the throttle openings is in the range between a lower limit value and an upper limit value as shown in FIG. 12. Therefore, even when the engine rotational speeds are increased or decreased by temporary fluctuations in loads caused by waves or entrainment of air by propellers, it is possible to prevent overcorrection or undercorrection and to execute a more stable control for the synchronization of the engine rotational speeds.

The configuration of the control devices 18M9 and 18R9 is next described with reference to FIG. 13. The control devices 18M9 and 18R9 are constituted similarly and executes the following cancel determination to cancel the control for the synchronization of the engine rotational speeds of the propulsion units.

Since a protective control such as stopping an engine is executed based on a failure signal from the failure detection device for detecting failures of the vessel or the propulsion units, failure state cancel determination parts 18M93 and 18R93 determine the presence or absence of a protective control as a cancel determination condition of the control for the synchronization of the engine rotational speeds, and the control for the synchronization of the engine rotational speed of the propulsion units is cancelled when a protective control is executed. When a sensor or actuator in systems of the propulsion units has a failure, it not only makes the rotation synchronizing control impossible but also may cause an unintentional behavior. Thus, a protective control for systems of a plurality of propulsion units is determined as a cancel determination condition of the rotation synchronizing control and the control for the synchronization of the engine rotational speeds of the propulsion units is cancelled when a protective control is executed to achieve a stable synchronizing control.

Since a warning control such as decreasing the engine rotational speed is executed based on an abnormality signal from the engine abnormality detection device for detecting engine abnormalities of the propulsion units, warning state cancel determination parts 18M94 and 18R94 determine the presence or absence of a warning control as a cancel determination condition, and the control for the synchronization of the engine rotational speeds of the propulsion units is cancelled when a warning control is executed. Since the presence or absence of a warning control is determined as a cancel determination condition, and the control for the synchronization of the engine rotational speeds of the propulsion units is cancelled when a warning control is executed as described above, the vessel is slowed down to protect the engines when a warning of overheat or a drop in hydraulic pressure is provided. The control for the synchronization of the engine rotational speeds of the propulsion units is not cancelled when a warning control is executed to protect the engines when a warning is provided.

Cancel determination established state determination part 18M95 and 18R95 determine the duration for which the cancel determination condition has continued as a cancel execution condition, and the control for the synchronization of the engine rotational speeds of the propulsion units is cancelled when the cancel determination condition is continued for a prescribed duration. In the environment in which the propulsion units are used, the load conditions are changed by various factors such as waves and tides, and a cancel determination condition may be satisfied for a moment. Thus, the duration for which a cancel determination condition has continued is determined as a cancel execution condition to cancel the control for the synchronization of the engine rotational speeds, and the control for the synchronization of the engine rotational speeds of the propulsion units is cancelled when the cancel determination condition is continued for a prescribed duration to achieve a stable rotation synchronizing control.

Engine rotational speed synchronization cancel determination part 18M96 and 18R96 make a cancel determination to cancel the control for the synchronization of the engine rotational speeds of the propulsion units as described below.

In step f1, it is determined whether the engine rotational speed of the reference propulsion unit 5L is outside the range between an upper limit rotational speed and a lower limit rotational speed, and it is determined whether the engine rotational speeds of the target propulsion units 5M and 5R are outside the range between the upper limit rotational speed and the lower limit rotational speed. For example, the upper limit rotational speed and the lower limit rotational speed of the engine rotational speeds are 6000 rpm and 500 rpm, respectively, in one preferred embodiment. When the engine rotational speed of one of the propulsion units is outside the range between an upper limit rotational speed and a lower limit rotational speed as described above, the control for the synchronization of the engine rotational speeds of the propulsion units is cancelled to achieve stable operation of the engines.

It is determined, based on the engine rotational speeds of the target propulsion units 5M and 5R, whether the operating conditions of the engines do not permit the control for the synchronization of the engine rotational speeds to be executed. If the conditions do not permit, cancel the control for the synchronization of the engine rotational speeds of the propulsion units is allowed for protection of the engines or other reasons.

Also, deviations in engine rotational speed are calculated, and it is determined whether the deviations in engine rotational speed are outside a specified range. If they are outside the specified range, cancel of the control for the synchronization of the engine rotational speeds of the propulsion units is allowed for protection of the engines or other reasons.

In a vessel having a plurality of propulsion units, the loads vary depending on the variation or installation positions of the engines of the propulsion units and the maximum rotational speeds of the engines differ from one another. When the maximum rotational speed of the reference propulsion unit is the highest, there is a possibility that the target propulsion units cannot be fully corrected. Thus, the upper limit rotational speed of the engine rotational speed of one of the propulsion units is determined as a cancel determination condition, and the control for the synchronization of the engine rotational speeds of the propulsion units is cancelled when the engine rotational speeds are equal to or higher than the upper limit rotational speed to achieve a stable synchronizing control. The value of the upper limit rotational speed as a cancel determination condition is greater than the value of the upper limit rotational speed as a determination condition of a synchronizing control.

In engine control at a time when the throttle openings are small, a control for achieving an idle rotational speed by correction of throttle opening and correction of ignition timing preferably is conventionally executed. Thus, the lower limit rotational speed of the engine rotational speed of one of the propulsion units is determined as a synchronization control cancel determination condition and the control for the synchronization of the engine rotational speed of the propulsion units is cancelled when the engine rotational speeds are equal to or lower than the lower limit rotational speed. Therefore, a control of an idle rotational speed and a rotation synchronizing control preferably are not executed simultaneously, and stable rotation of the engines can be achieved. The value of the lower limit rotational speed as a cancel determination condition is smaller than the value of the lower limit rotational speed as a determination condition of synchronizing control.

In step f2, based on the shift position of the control lever for the reference propulsion unit, the shift input state thereof is determined, and, based on the shift position of the control lever for the target propulsion units, the shift input state thereof is determined. If they are in an input state, it is determined whether their shift positions do not coincide with each other as a cancel determination condition of the control for the synchronization of the engine rotational speeds. If the shift positions do not coincide with each other, cancel of the control for the synchronization of the engine rotational speeds of the propulsion units is allowed. When the shift positions of a plurality of propulsion units are different, the load conditions are different, which makes rotation synchronization difficult and does not meet the intention to achieve smooth cruising. Thus, the inconsistency of the shift positions is determined as a cancel determination condition of the control for the synchronization of the engine rotational speeds, and the control for the synchronization of the engine rotational speeds of the propulsion units is cancelled when the shift positions are inconsistent to achieve a control in accordance with the intention of the operator to synchronize the engine rotational speeds of a plurality of propulsion units.

In step f3, the lever position of the control lever for the reference propulsion unit and the lever position of the control lever for the target propulsion units are computed, and it is determined whether each of the lever positions is outside the range between an upper limit angle and a lower limit angle. If each of the lever positions is outside the range between the upper limit angle and the lower limit angle, cancel of the control for the synchronization of the engine rotational speeds of the propulsion units is allowed. Also, a deviation in lever position is computed, and cancel of the control for the synchronization of the engine rotational speed of the propulsion units is allowed when the deviation is outside a specified range. For example, the deviation in lever position at which the control for the synchronization of the engine rotational speed of the propulsion units is cancelled is greater than the value of deviation in lever position at which the control for the synchronization of the engine rotational speeds is executed. Since a deviation in lever position is determined as a determination condition of cancel of the control for the synchronization of the engine rotational speeds and it is determined whether the control levers for a plurality of propulsion units are in different angle positions from the deviation in lever position as described above, a rotation synchronizing control in accordance with the intention of the operator to cancel the rotation synchronization can be achieved.

When a vessel having a plurality of propulsion units is steered, the control levers are considered to be operated frequently to change directions or make turns during traveling at a low speed. In this case, the steering intention of the operator may be inhibited if a rotation synchronizing control can be started to easily. However, the operator often wants to synchronize the engine rotational speeds quickly and precisely when in the cruising range of speeds. Thus, a cancel execution condition is set based on the lever angles of the control levers so that a rotation synchronizing control in accordance with the steering intention of the operator can be achieved.

In step f4, the throttle opening of the reference propulsion unit and the throttle openings of the target propulsion units are computed, and it is determined whether each of the throttle openings is outside a specified range between an upper limit and a lower limit. If each of the throttle openings is outside the specified range, the control for the synchronization of the engine rotational speeds of the propulsion units is cancelled.

Also, deviations between the throttle opening of the reference propulsion unit and the throttle openings of the target propulsion units are computed as a cancel determination condition of the control for the synchronization of the engine rotational speeds. When the deviation values are outside a specified range, the control for the synchronization of the engine rotational speeds of the propulsion units is cancelled. For example, the deviation value of throttle opening is 5° in one embodiment, and, when it is outside the specified range, the control for the synchronization of the engine rotational speeds of the propulsion units is cancelled to achieve a stable rotation synchronizing control which can synchronize the engine rotational speeds of a plurality of propulsion units. That is, the device for detecting the intention of the operator to achieve rotation synchronization is the control lever angles whereas the amount of air which determines the outputs of the propulsion units is adjusted by throttle openings. Thus, deviations in throttle opening are determined as a cancel determination condition of the control of synchronizing the engine rotational speeds, and the control of synchronizing the engine rotational speeds of the propulsion units is cancelled when the deviation values are outside a specified range. As described above, it is determined whether the deviations between the throttle opening of the reference propulsion unit and the throttle openings of the target propulsion units are equal to or larger than a specified value as a cancel determination condition of synchronization control cancel to achieve a stable synchronization control.

In step f5, it is determined whether throttle openings obtained from throttle position sensor values of the target propulsion units are in a specified range between an upper limit and a lower limit. The throttle openings of the target propulsion units are determined as a cancel determination condition of the control for the synchronization of the engine rotational speeds, and the control for the synchronization of the engine rotational speeds of the propulsion units is allowed.

Figure 14:
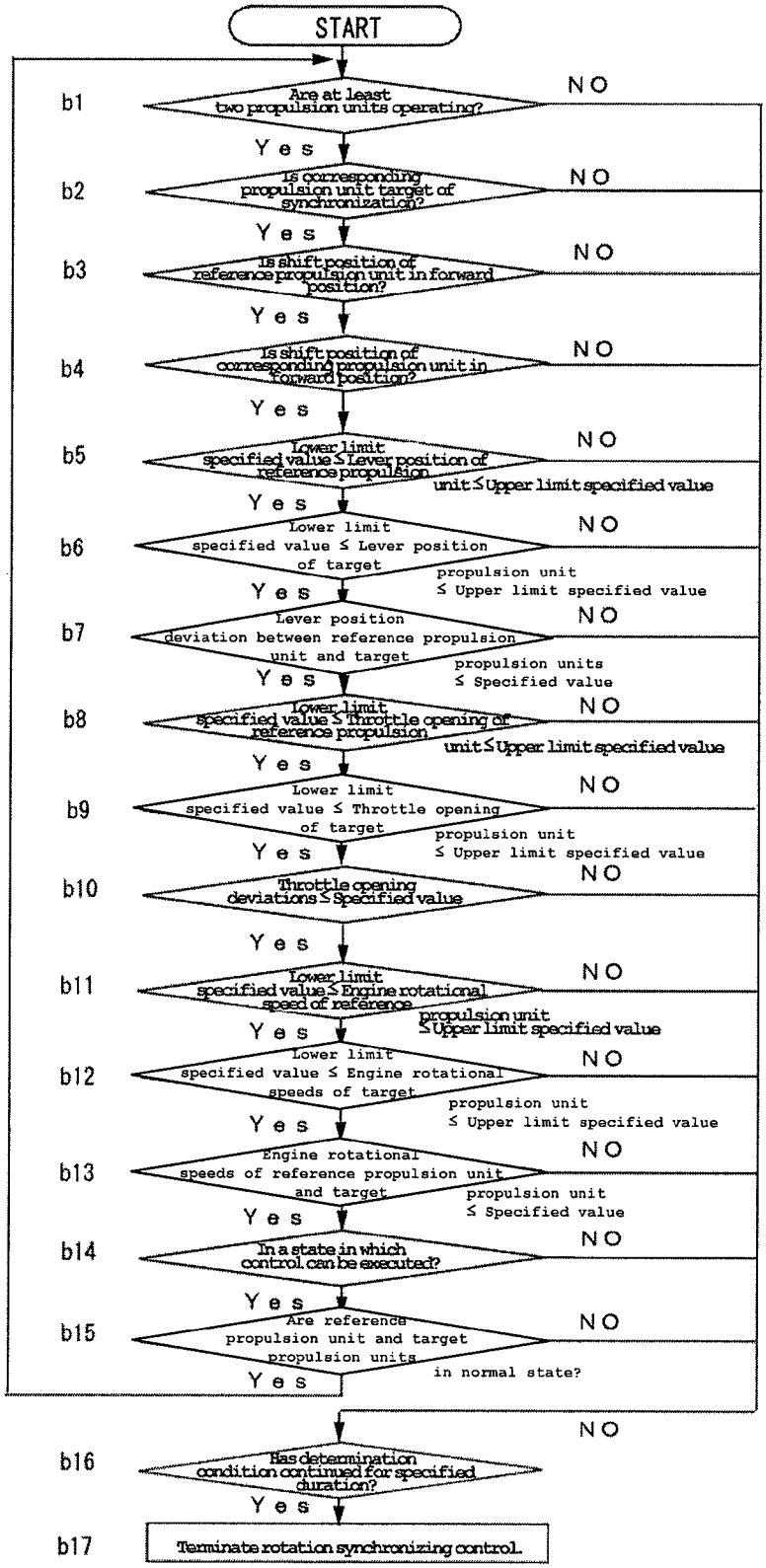
FIG. 14 is a flowchart of an embodiment of a rotation synchronizing control cancel determination.

The flowchart of an embodiment of a rotation synchronizing control cancel determination shown in FIG. 14 is next described.

In step c1, the control devices 18M9 and 18R9 of the target propulsion units 5M and 5R determine whether the reference propulsion unit 5L is in a connected state based on information about the reference propulsion unit 5L such as lever position, shift position, throttle opening, and engine rotational speed to determine whether at least two propulsion units are operating.

In step c2, if at least two propulsion units are operating, it is determined whether its corresponding propulsion unit is the target propulsion unit 5M or the target propulsion unit 5R.

In step c3, it is determined whether the shift position of the reference propulsion unit 5L is in the forward position if its corresponding propulsion unit is the target propulsion unit 5M or the target propulsion unit 5R.

In step c4, if the shift position of the reference propulsion unit 5L is in the forward position, it is determined whether the shift position of its corresponding target propulsion unit 5M or 5R is in the forward position.

In step c5, it is determined whether the lever position of the reference propulsion unit 5L is in a specified range between a lower limit specified value and an upper limit specified value if the shift position of its corresponding target propulsion unit 5M or 5R is in the forward position.

In step c6, if the lever position of the reference propulsion unit 5L, is in the range between a lower limit specified value and an upper limit specified value, it is determined whether the lever position of the target propulsion units 5M and 5R is in a specified range between a lower limit specified value and an upper limit specified value.

In step a7, if the lever position of the target propulsion units 5M and 5R is in the range between a lower limit specified value and an upper limit specified value, it is determined whether the deviation in lever position is equal to or smaller than a specified value.

In step c8, if the deviation in lever position is equal to or smaller than a specified value, it is determined whether the throttle opening of the reference propulsion unit 5L is in the range between a lower limit specified value and an upper limit specified value.

In step c9, if the throttle opening of the reference propulsion unit 5L is in the range between a lower limit specified value and an upper limit specified value, it is determined whether the throttle openings of the target propulsion units 5M and 5R are in a specified range between a lower limit specified value and an upper limit specified value.

In step c10, if the throttle openings of the target propulsion units 5M and 5R are in the range between a lower limit specified value and an upper limit specified value, it is determined whether the deviations in throttle opening are equal to or smaller than a specified value.

In step c11, if the deviations in throttle opening are equal to or smaller than a specified value, it is determined whether the engine rotational speed of the reference propulsion unit 5L is in a specified range between a lower limit rotational speed and an upper limit rotational speed.

In step c12, if the engine rotational speed of the reference propulsion unit 5L is in the range between a lower limit rotational speed and an upper limit rotational speed, it is determined whether the engine rotational speeds of the target propulsion units 5M and 5R are in a specified range between a lower limit rotational speed and an upper limit rotational speed.

In step c13, if the engine rotational speeds of the target propulsion units 5M and 5R are in the specified range between a lower limit rotational speed and an upper limit rotational speed, it is determined whether the deviation values in engine rotational speed are equal to or smaller than a specified value.

In step c14, if the deviations in engine rotational speed are equal to or smaller than a specified value, the presence or absence of a warning control in each propulsion unit is determined as a cancel determination condition to cancel the control for the synchronization of the engine rotational speeds.

In step c15, a protective control is executed based on failure signals from the failure detection device for detecting failures of the vessel or each propulsion unit, and the presence or absence of a protective control is determined as a cancel determination condition to cancel the control for the synchronization of the engine rotational speeds.

If the determination is Yes in step c1 to step c15, the process returns to start and is repeated. If the determination is No in any of the steps, it is determined whether the duration for which a determination of No has continued is longer than a specified time period in step c16. In some embodiments, the duration for which the cancel determination condition has continued, a period of 2 to 3 second, for example, is determined as a cancel execution condition to cancel the control for the synchronization of the engine rotational speeds.

In step c17, if the cancel determination condition has continued for a specified duration, a control for the synchronization of the engine rotational speeds is cancelled. As described above, according to the steering intention of the operator, since the operator wants to synchronize the rotation quickly during cruising, for example, the determination condition is intended to start a synchronizing control. However, it is preferred that the control cannot be cancelled easily for stable cruising. Thus, in a preferred embodiment there is a determination condition of the control for the synchronization of the engine rotational speeds of the propulsion units as targets of synchronization with the engine rotational speed of the reference propulsion unit, and a cancel condition of the control is provided in addition to the determination condition to achieve a synchronizing control in accordance with the steering intention of the operator.

As described above, when the cancel determination condition has continued for a specified duration, the control for the synchronization of the engine rotational speeds of the propulsion units is cancelled in some preferred embodiments. An embodiment of the control for the synchronization of the engine rotational speeds is shown in FIG. 15 to FIG. 20. FIG.

Figure 16:
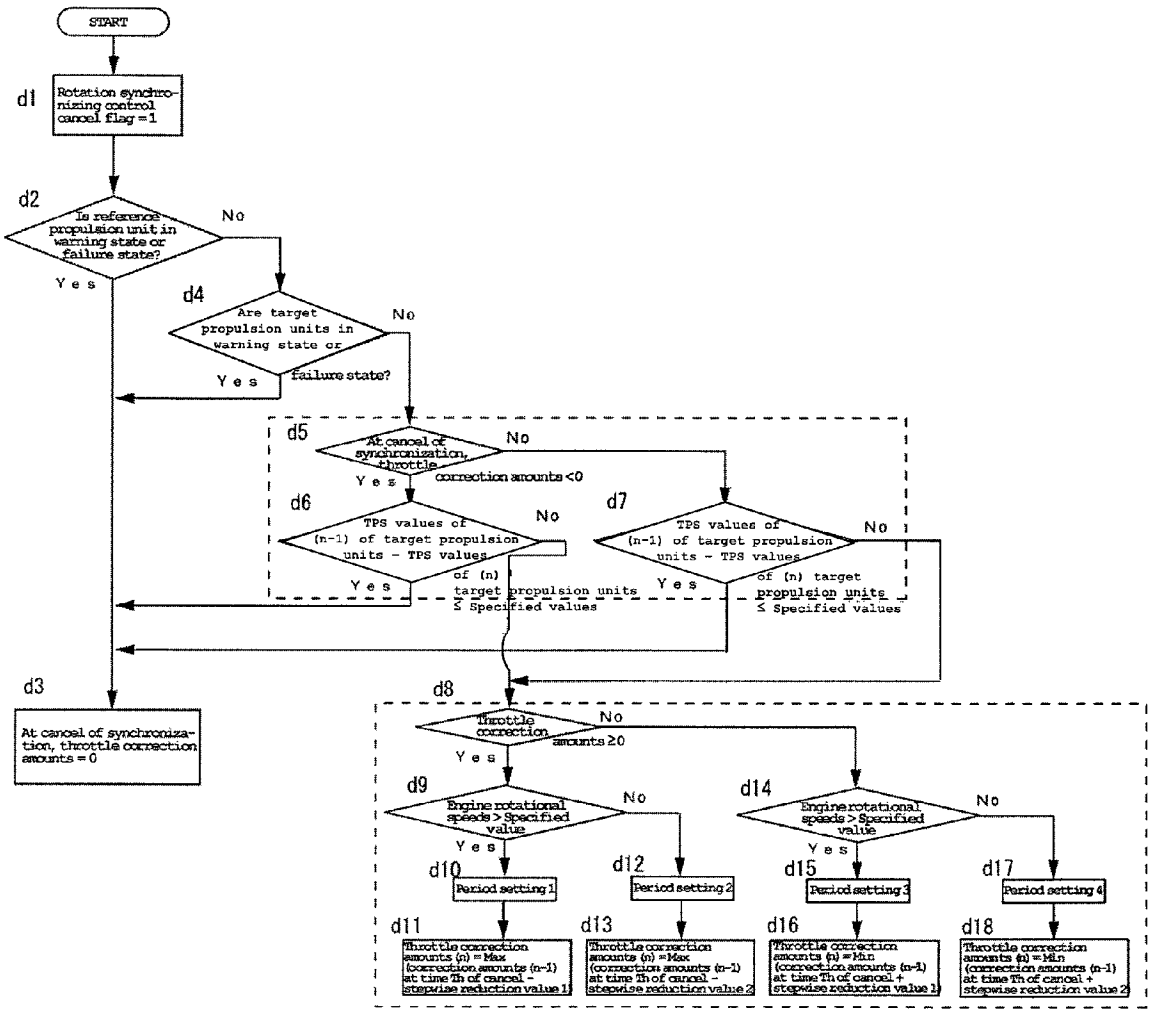
FIG. 16 is a flowchart cancellation of the rotation synchronizing control.
Figure 17:
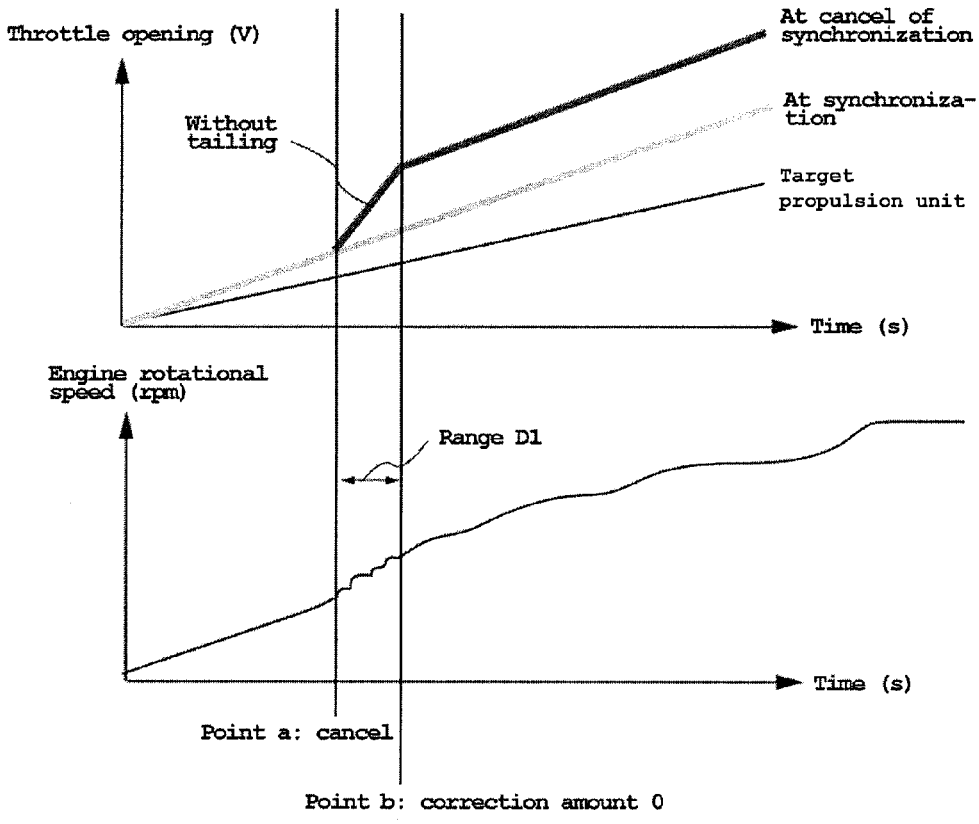
FIG. 17 is a view illustrating a state in which the correction of throttle openings is not reduced stepwise when the rotation synchronizing control is cancelled.
Figure 18:
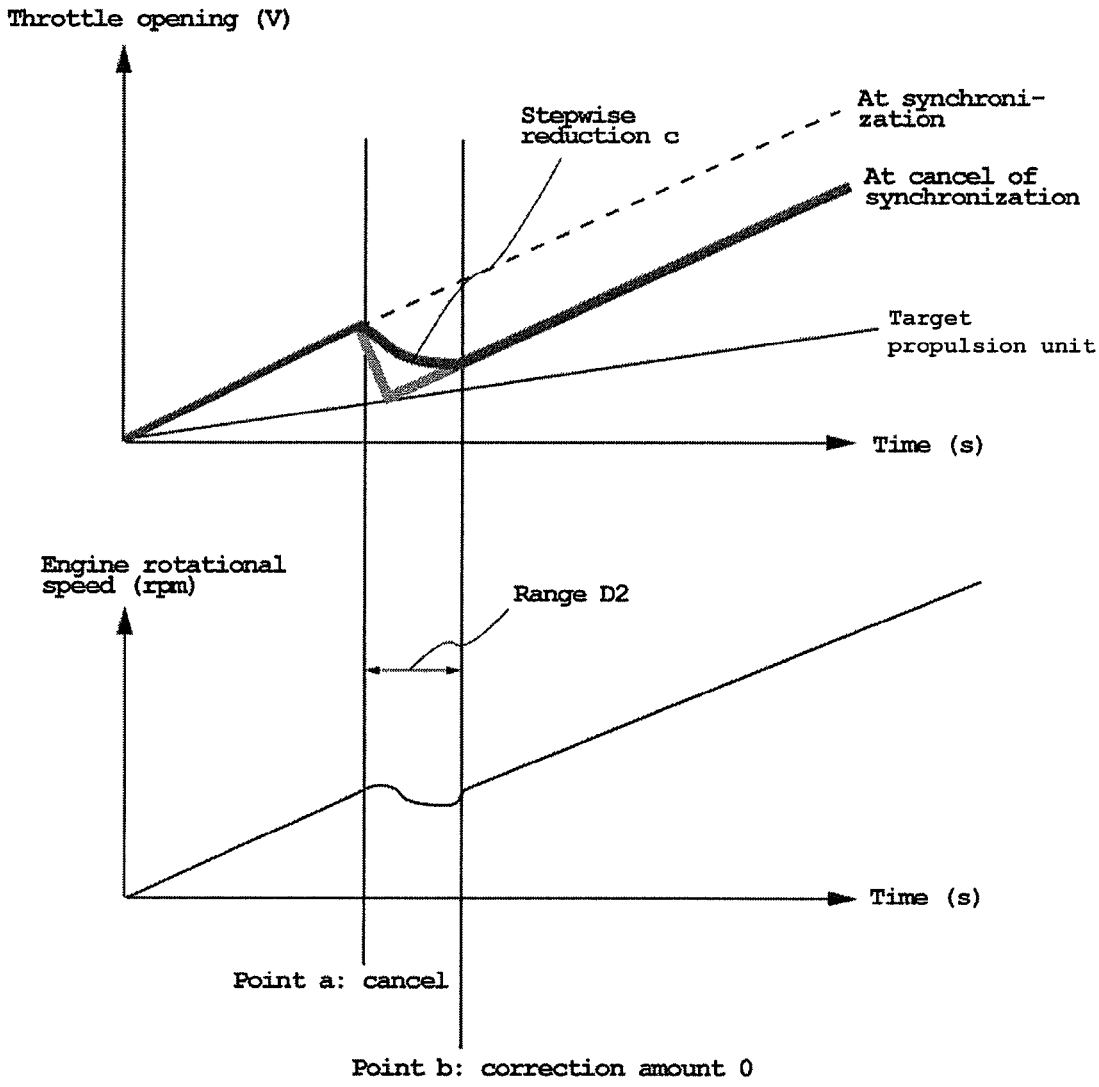
FIG. 18 is a view illustrating a state in which the correction of throttle openings is reduced stepwise when the rotation synchronizing control is cancelled.
Figure 19:
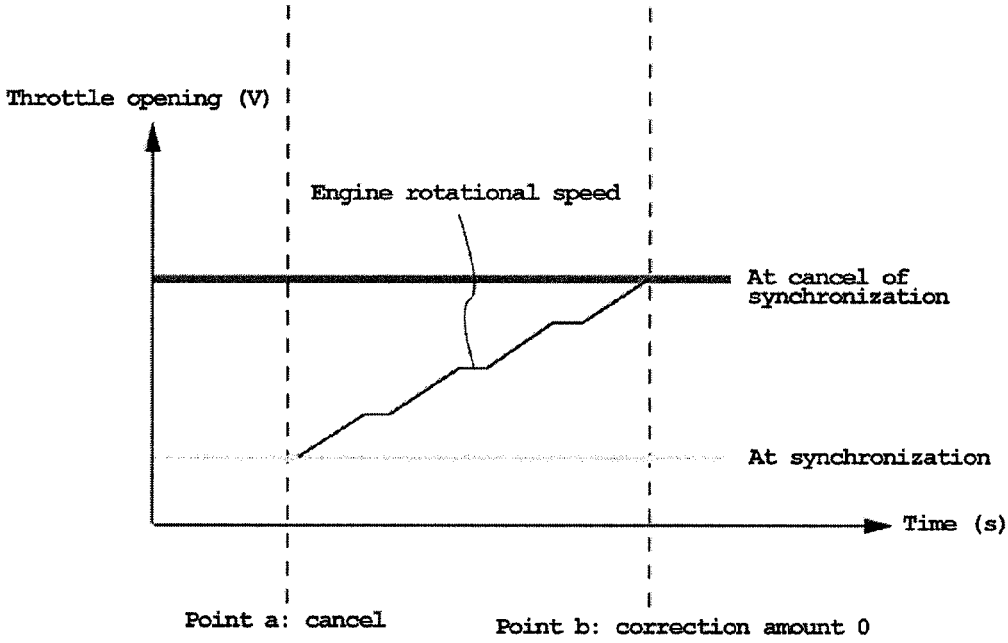
FIG. 19 is a view illustrating a state in which the correction of throttle openings is reduced stepwise when the rotation synchronizing control is cancelled and engine rotational speeds are high.
Figure 20:
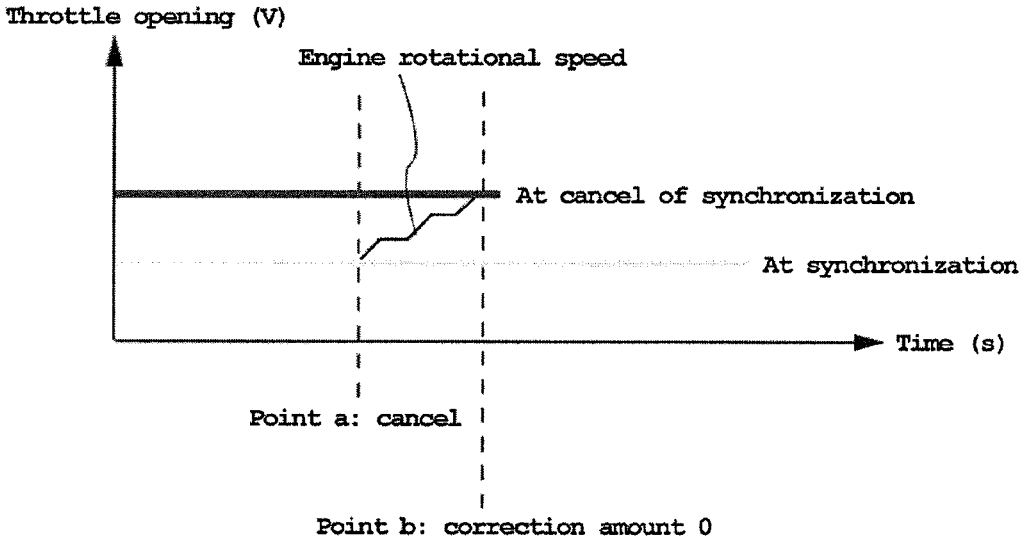
FIG. 20 is a view illustrating a state in which the correction of throttle openings is reduced stepwise the rotation synchronizing control is cancelled and engine rotational speeds are low.

15 is a block diagram of cancel of the rotation synchronizing control, FIG. 16 is a flowchart of the cancel of the rotation synchronizing control, FIG. 17 is a view illustrating a state in which the correction of throttle openings is not reduced stepwise in cancelling the rotation synchronizing control, FIG. 18 is a view illustrating a state in which the correction of throttle openings is reduced stepwise in cancelling the rotation synchronizing control, FIG. 19 is a view illustrating a state in which the correction of throttle openings is reduced stepwise in cancelling the rotation synchronizing control when the engine rotational speeds are high, and FIG. 20 is a view illustrating a state in which the correction of throttle openings is reduced stepwise in cancelling the rotation synchronizing control when the engine rotational speeds are low.

Figure 13:
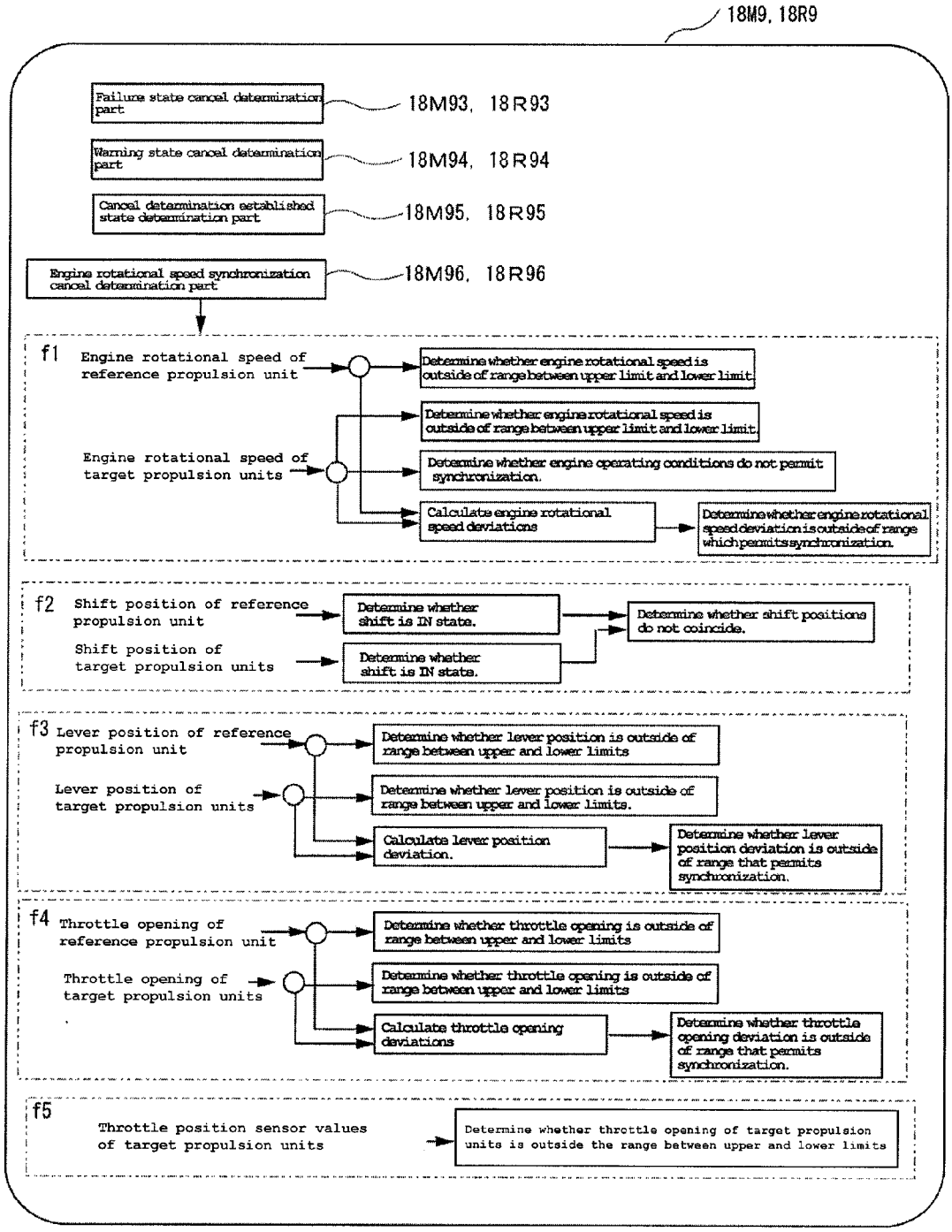
FIG. 13 is a block diagram showing cancellation of a rotation synchronizing control in accordance with an embodiment.
Figure 15:
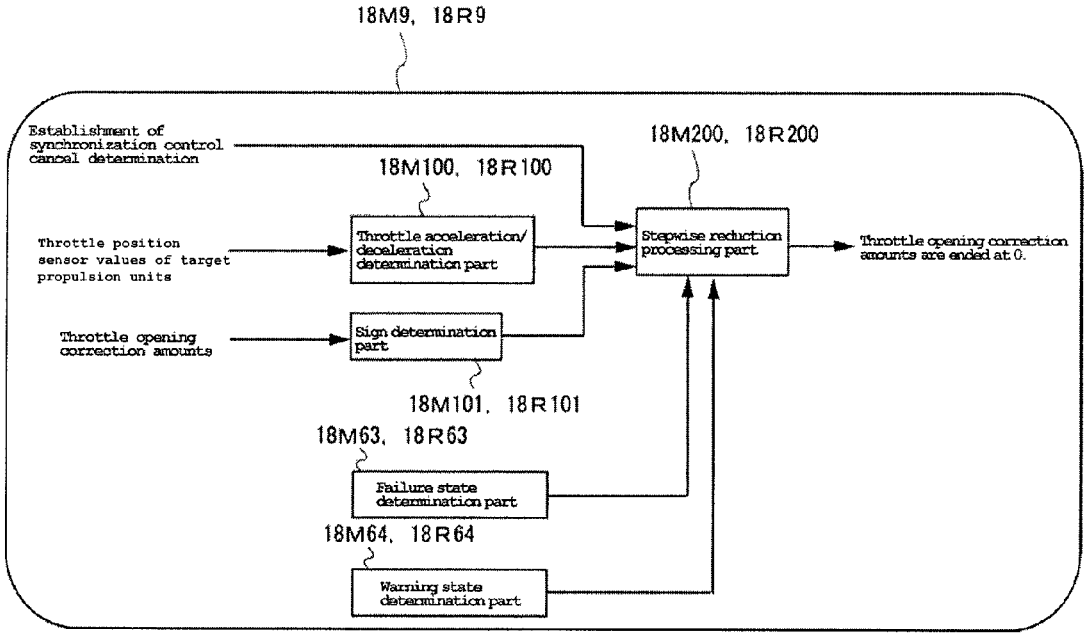
FIG. 15 is a block diagram showing cancellation of a rotation synchronizing control in accordance with an embodiment.

The control devices 18M9 and 18R9 of this embodiment preferably have throttle acceleration/deceleration determination parts 18M100 and 18R100, and sign determination parts 18M101 and 18R101, respectively, as shown in FIG. 15 in addition to the constitution shown in FIG. 13. The throttle acceleration/deceleration determination parts 18M100 and 18R100 determine whether the vessel is accelerating or decelerating by determining whether the throttles have been operated to the opening direction or the closing direction based on throttle position information of the propulsion units 5M and 5R as targets of synchronization. The sign determination parts 18M101 and 18R101 determine, based on throttle opening correction amounts for the target propulsion units 5M and 5R, a positive sign when the throttle opening correction amounts are increased for acceleration and a negative sign when the throttle openings are reduced for deceleration.

In a preferred embodiment, when any of the failure state cancel determination parts 18M93 and 18R93, the warning state cancel determination parts 18M94 and 18R94, the cancel determination established state determination parts 18M95 and 18R95, and the engine rotational speed synchronization cancel determination parts 18M96 and 18R96 makes a cancel determination to cancel the control for the synchronization of the engine rotational speeds, and when the failure state determination parts 18M63 and 18R63 determine that there is no failure state and the warning state determination parts 18M64 and 18R64 determine that there is no warning state, stepwise reduction processing parts 18M200 and 18R200 reduce the corrections of the throttle openings stepwise based on the determination to decelerate by the throttle acceleration/deceleration determination parts 18M100 and 18R100 and the determination to reduce the throttle opening correction amounts by the sign determination parts 18M101 and 18R101 to make the throttle opening correction amounts to end at 0 and to restore the throttle openings from the corrected throttle openings to the throttle openings based on the control lever position.

In this embodiment, a control for the synchronization of the engine rotational speeds is carried out by correcting the throttle openings of the target propulsion units 5M and 5R based on deviations between the engine rotational speed of the reference propulsion unit 5L and the engine rotational speeds of the propulsion units 5M and 5R as targets of synchronization, and then the control for the synchronization of the engine rotational speeds is cancelled. If the correction of the throttle openings were to be suddenly reduced when this cancel is made, the throttle openings may change significantly to cause rotational fluctuations. Thus, in this embodiment when the control for the synchronization of the engine rotational speeds is cancelled, the correction of the throttle openings is reduced stepwise to restore the throttle openings from the corrected throttle openings to the throttle openings based on the control lever position by a control of the stepwise reduction processing part 18M200 and 18R200. It is therefore possible to prevent large rotational fluctuations and to achieve natural steering feel.

The control of the stepwise reduction processing part 18M200 and 18R200 according to a preferred embodiment is described with reference to a flowchart of the cancel of the rotation synchronizing control shown in FIG. 16.

In step d1, if any of the failure state cancel determination parts 18M93 and 18R93, the warning state cancel determination parts 18M94 and 18R94, the cancel determination established state determination parts 18M95 and 18R95, and the engine rotational speed synchronization cancel determination parts 18M96 and 18R96 makes a cancel determination to cancel the control for the synchronization of the engine rotational speeds, a rotation synchronizing control cancel flag is set to "1."

In step d2, it is determined whether the reference propulsion unit 5L is in a warning or a failure state.

In step d3, if the reference propulsion unit 5L is in a warning or a failure state, the synchronizing control is cancelled, and the throttle opening correction amounts are set to end at 0 and the throttle openings are restored from the corrected throttle openings to the throttle openings based on the control lever position.

In step d4, if the reference propulsion unit 5L is not in a warning or a failure state, it is determined whether the target propulsion units 5M and 5R are in a warning state or a failure state. If the target propulsion units 5M and 5R are in a warning state or a failure state, the process goes to step d3.

In step d5, after it is determined that the target propulsion units 5M and 5R are not in a warning state or a failure state in step d4, it is determined whether the throttle opening correction amounts are equal to or smaller than 0 when the synchronizing control is cancelled.

In step d6, if the throttle opening correction amounts are equal to or smaller than 0 when the synchronizing control is cancelled in step d5, it is determined whether the values obtained by subtracting the values TPS(n−1) of the throttle opening of the target propulsion units 5M and 5R in the previous cycle from the current values TPS(n) thereof are greater than a specified value. If they are greater than the specified value, the process goes to step d3, and if they are smaller than the specified value, the process goes to step d8.

In step d7, if the throttle opening correction amounts are not equal to or smaller than 0 when the synchronizing control is cancelled in step d5, it is determined whether the values obtained by subtracting the current values TPS(n) of the throttle opening of the target propulsion units 5M and 5R from the value TPS(n−1) thereof in the previous cycle are smaller than a specified value. If they are smaller than the specified value, the process goes to step d3, and if they are greater than the specified value, the process goes to step d8.

In step d8, it is determined whether the throttle opening correction amounts are equal to or greater than 0. If they are equal to or greater than 0, the process goes to step d9. If they are not equal to or greater than 0, the process goes to step d14.

In step d9, it is determined whether the engine rotational speeds of the target propulsion units 5M and 5R are equal to or higher than a specified value. If the engine rotational speeds are equal to or higher than the specified value, the process goes to step d10. If the engine rotational speeds are not equal to or higher than the specified value, the process goes to step d12.

In step d10, if the engine rotational speeds are equal to or higher than the specified value, a period setting 1 is carried out.

In step d11, in the case of the period setting 1, the corrections (n) of the throttle openings are achieved by subtracting a stepwise reduction value 1 from the correction amounts (n−1) at the time Th of cancel.

In step d12, if the engine rotational speeds are not equal to or higher than the specified value, a period setting 2 is carried out.

In step d13, in the case of the period setting 2, the corrections (n) of the throttle openings are achieved by subtracting a stepwise reduction value 2 from the correction amounts (n−1) at the time Th of cancel.

In step d14, it is determined whether the engine rotational speeds of the target propulsion units 5M and 5R are equal to or higher than a specified value. If the engine rotational speeds are equal to or higher than the specified value, the process goes to step d15. If the engine rotational speeds are not equal to or higher than the specified value, the process goes to step d17.

In step d15, if the engine rotational speeds are equal to or higher than the specified value, a period setting 3 is carried out.

In step d16, in the case of the period setting 3, the corrections (n) of the throttle openings are achieved by adding a stepwise reduction value 1 to the correction amounts (n−1) at the time Th of cancel.

In step d17, if the engine rotational speeds are not equal to or higher than the specified value, a period setting 4 is carried out.

In step d18, in the case of the period setting 4, the corrections (n) of the throttle openings are achieved by adding a stepwise reduction value 2 to the correction amounts (n−1) at the time Th of cancel.

In the flowchart of the cancel of the rotation synchronizing control shown in FIG. 16, the correction of the throttle openings is not reduced stepwise in steps d5 to d7 as shown in FIG. 17. That is, when the synchronizing control is cancelled at a point indicated as "a", if the throttle opening correction amounts are equal to or smaller than 0 and if the values obtained by subtracting the values TPS(n−1) of the throttle openings of the target propulsion units 5M and 5R in the previous cycle from the current values TPS(n) are greater than a specified value, the throttle opening correction amounts are set to end at 0 a prescribed period of time later at a point of time indicated as "b" to restore the throttle openings from the corrected throttle openings to throttle openings based on the control lever positions.

When the synchronizing control is cancelled at a point indicated as "a", if the throttle opening correction amounts are not equal to or smaller than 0 and if the values obtained by subtracting the current values TPS(n) of the throttle openings of the target propulsion units 5M and 5R from the values TPS(n−1) in the previous cycle are smaller than a specified value, the throttle opening correction amounts are set to end at 0 a prescribed period of time later at a point of time indicated as "b" to restore the throttle openings from the corrected throttle openings to throttle openings based on the control lever positions.

As described above, during acceleration, when the synchronizing control is cancelled at a point indicated as "a", the throttle opening correction amounts are set to end at 0 a prescribed period of time later at the point "b" to restore the throttle openings from the corrected throttle openings to throttle openings based on the control lever position. In this case, although the engine rotational speeds slightly increase in a range indicated as D1, since the vessel is accelerating, the throttle openings are restored to normal throttle openings quickly, especially during acceleration, while the operator does not notice rotational fluctuations.

In the flowchart of the cancel of the rotation synchronizing control shown in FIG. 16, the correction of the throttle openings is reduced stepwise in steps d8 to d18 as shown in FIG. 18 to FIG. 20. That is, when a synchronizing control is cancelled at point indicated as "a" as shown in FIG. 18, if the throttle opening correction amounts are equal to or greater than 0 and if the engine rotational speeds of the target propulsion units 5M and 5R are equal to or higher than a specified value, a period setting 1 is executed, corrections (n) of the throttle openings are obtained by subtracting a stepwise reduction value 1 from the correction amounts (n−1) at the time Th of cancel, and the throttle opening correction amounts are set to end a prescribed period of time later at a point of time indicated as "b" to restore the throttle openings from the corrected throttle openings to throttle openings based on the control lever positions.

Also, when a synchronizing control is cancelled at point "a", if the throttle opening correction amounts are equal to or greater than 0 and if the engine rotational speeds of the target propulsion units 5M and 5R are not equal to or higher than a specified value, a period setting 2 is executed, correction (n) of the throttle openings are obtained by subtracting a stepwise reduction value 2 from the correction amounts (n−1) at the time Th of cancel, and the throttle opening correction amounts are set to end a prescribed period of time later at a point of time indicated as "b" to restore the throttle openings from the corrected throttle openings to throttle openings based on the control lever positions.

Also, when a synchronizing control is cancelled at a point indicated as a, if the throttle opening correction amounts are not equal to or greater than 0 and if the engine rotational speeds of the target propulsion units 5M and 5R are equal to or higher than a specified value, a period setting 3 is executed, corrections (n) of the throttle openings are obtained by adding a stepwise reduction value 1 to the correction amounts (n−1) at the time Th of cancel, and the throttle opening correction amounts are set to end a prescribed period of time later at a point of time indicated as b to restore the throttle openings from the corrected throttle openings to throttle openings based on the control lever positions.

Also, when a synchronizing control is cancelled at a point indicated as "a", if the throttle opening correction amounts are not equal to or greater than 0 and if the engine rotational speeds of the target propulsion units 5M and 5R are not equal to or higher than a specified value, a period setting 4 is executed, corrections (n) of the throttle openings are obtained by adding a stepwise reduction value 2 to the correction amounts (n−1) at the time Th of cancel, and the throttle opening correction amounts are set to end a prescribed period of time later at a point of time indicated as "b" to restore the throttle openings from the corrected throttle openings to throttle openings based on the control lever positions.

As described above, during acceleration, when the synchronizing control is cancelled at a point indicated as "a", the throttle opening correction amounts are set to end at 0 a prescribed period of time later at the point "b" to restore the throttle openings from the corrected throttle openings to throttle openings based on the control lever positions. In this case, in order to prevent the throttle opening correction amounts from decreasing from a positive value to 0 and the engine rotational speeds from decreasing while the vessel is accelerating, stepwise reduction "c" of the corrections of throttle openings is carried out in a range designated as D2.

In some embodiments the corrections of throttle openings are carried out in every cycle. The period is set based on the engine rotational speeds, and a tailing amount of delay in response is set based on the stepwise reduction. That is, when the engine rotational speeds are high, the period is set long and tailing value is set large as shown in FIG. 19. When the engine rotational speeds are low, the period is set short and the tailing value is set small as shown in FIG. 20.

By carrying out the stepwise reduction of corrections of the throttle openings in every cycle as described above, it is possible to prevent significant rotational fluctuations and to realize natural steering feel with a simple control. Also, the period of stepwise reduction in correction of the throttle openings is set based on the engine rotational speeds of the target propulsion units. Thus, when the vessel is traveling at low speed, since the correction is small, the correction can be reduced quickly. When the vessel is traveling at intermediate-high speed, since rotational fluctuations tend to be transmitted to the operator more easily, the period can be set longer to make them more smooth. It is, therefore, possible to realize natural steering.

Figure 21:
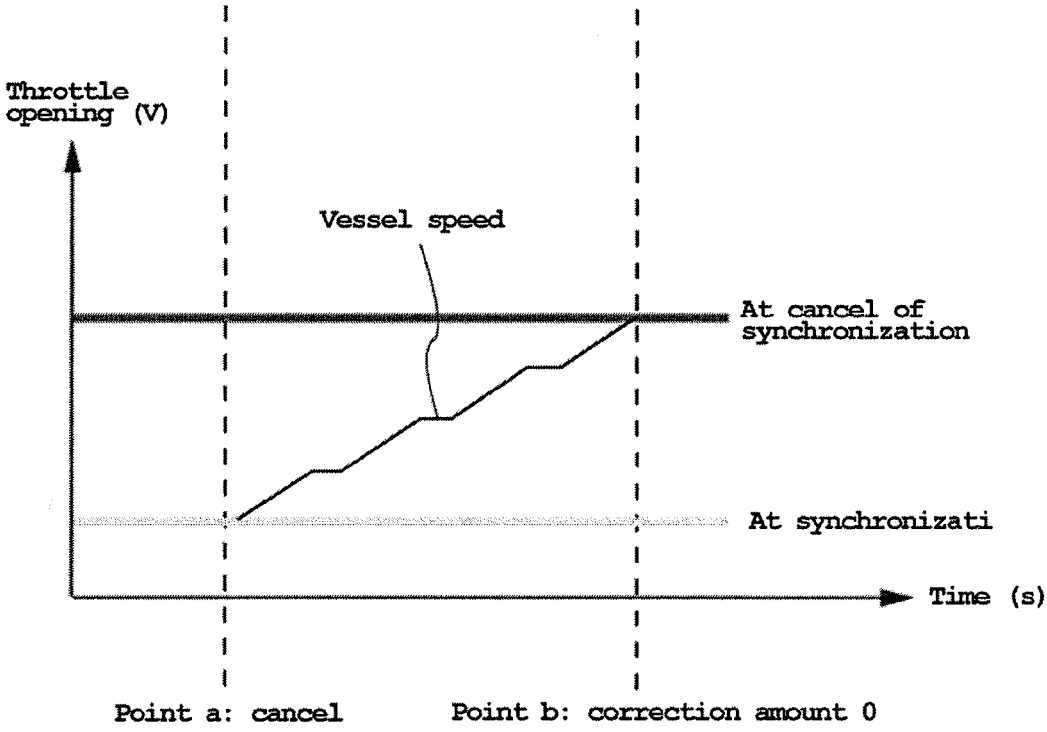
FIG. 21 is a view illustrating a state in which the correction of throttle openings is reduced stepwise when the rotation synchronizing control is cancelled and the vessel speed is high.
Figure 22:
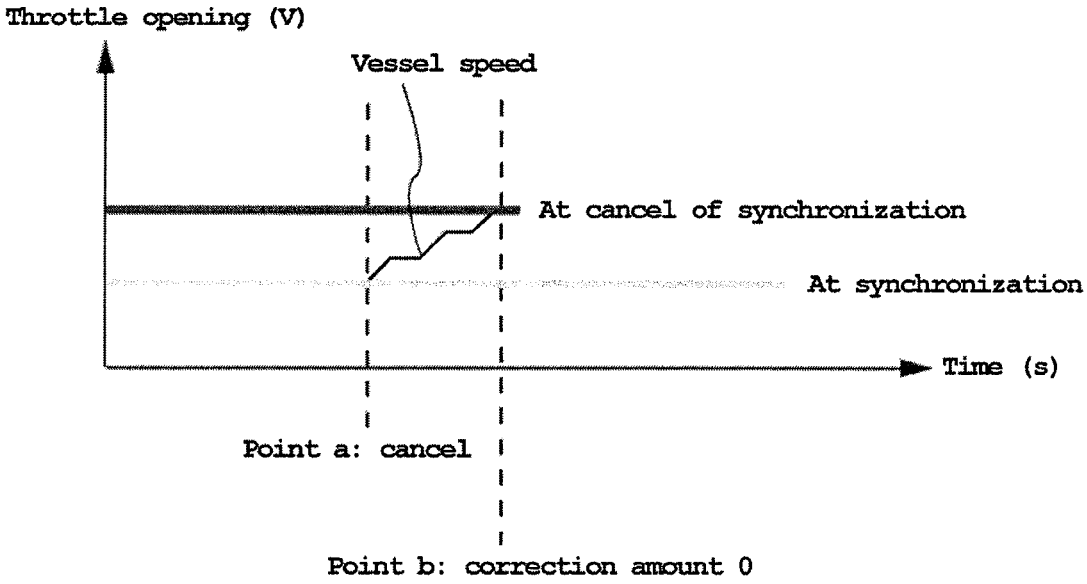
FIG. 22 is a view illustrating a state in which the correction of throttle openings is reduced stepwise when the rotation synchronizing control is cancelled and the vessel speed is low.

The period of stepwise reduction in correction of the throttle openings may be set based on a speed of the vessel obtained from the vessel speed detection devices 18M7 and 18R7 as shown in FIG. 21 and FIG. 22. Then, when the vessel is traveling at low speed as shown in FIG. 22, since the correction is small, the correction can be reduced quickly. When the vessel is traveling at intermediate-high speed as shown in FIG. 21, since rotational fluctuations tend to be transmitted to the operator more easily, the period can be set to make them more smooth. It is, therefore, possible to realize natural steering.

Figure 23:
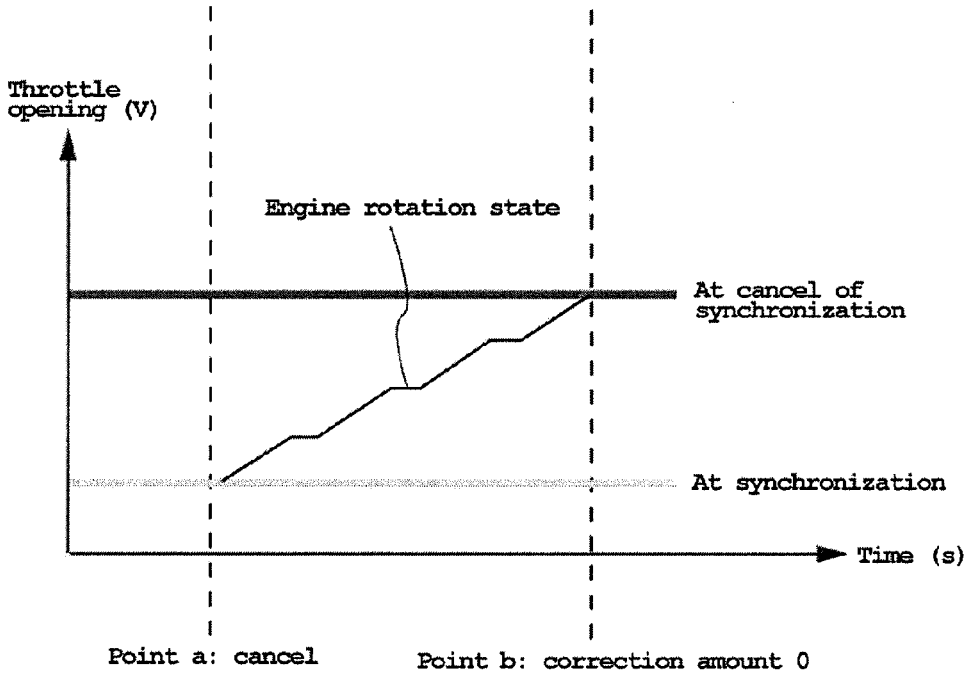
FIG. 23 is a view illustrating a state in which the correction of throttle openings is reduced stepwise when the rotation synchronizing control is cancelled and the loads are high.
Figure 24:
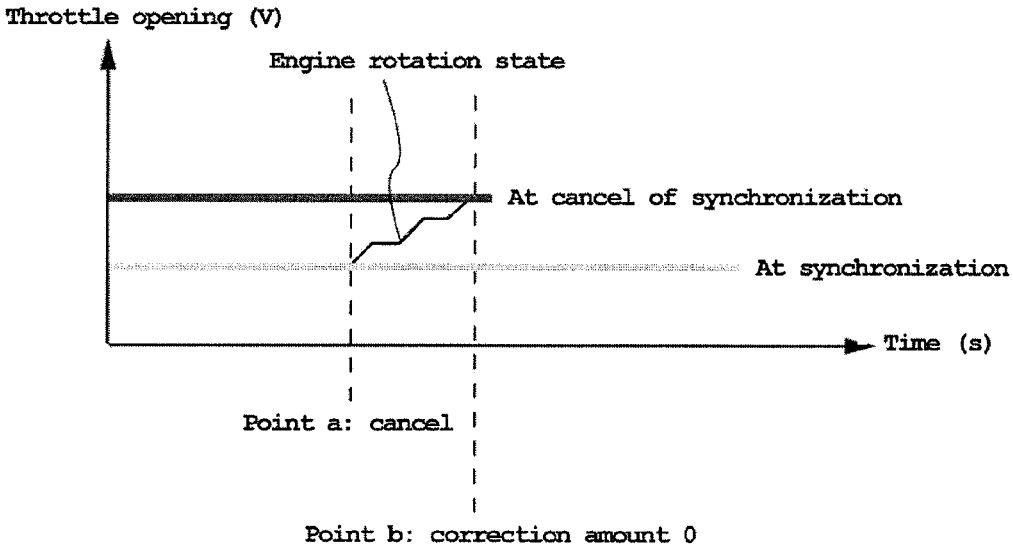
FIG. 24 is a view illustrating a state in which the correction of throttle openings is reduced stepwise when the rotation synchronizing control is cancelled and the loads are low.

Also, the amount by which the correction of the throttle openings is reduced in one step may be set based on the engine rotating states obtained from the load detection devices 18M8 and 18R8. When the engines are rotating under low loads as shown in FIG. 24, since the correction is small, the amount of reduction in one step can be reduced. When the engines are rotating under high loads as shown in FIG. 23, since the correction amounts are large, the amount by which the correction of the throttle openings is reduced in one step can be set large. It is, therefore, possible to realize natural steering.

The control which is executed to cancel the control for the synchronization of the engine rotational speeds is executed on condition that the correction of the throttle openings prior to the cancel has been completed. In the case where the throttle openings of the target propulsion units 5M and 5R has been corrected to the close side with reference to the propulsion unit 5L as a reference for rotation synchronization, when the control for synchronizing the engine rotational speeds is cancelled, the engine rotational speeds tends to decrease since the throttle openings are shifted to the close side. In the case where the throttle openings of the target propulsion units 5M and 5R have been corrected to the open side with reference to the reference propulsion unit 5L, when the control for synchronizing the engine rotational speeds is cancelled, the engine rotational speeds tend to increase since the throttle openings are shifted to the open side. When the vessel is accelerated, the influence of rotational fluctuations is small since the throttle openings are shifted to the open side. Thus, when the control which is executed to cancel the control for the synchronization of the engine rotational speeds is executed on condition that the correction of the throttle openings prior to the cancel has been completed, the stepwise reduction and period of correction can be set independently. It is, therefore, possible to prevent large rotational fluctuations and to realize natural steering feel.

The embodiments discussed herein are applicable, in particular, to a control device for propulsion units for a vessel having a plurality of propulsion units arranged in a row which synchronizes the engine rotational speeds of the propulsion units and cancel the control for synchronization, and can prevent significant rotational fluctuations when the control for the synchronization of the engine rotational speeds is canceled.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A propulsion unit control system for a vessel having plural propulsion units arranged side by side and electrically connected in association with two adjacent control levers that are controllable by an operator to operate a shift actuator and/or a throttle actuator of a corresponding one of the propulsion units, the control system comprising:

engine rotational speed detection devices adapted to detect an engine rotational speed of a reference propulsion unit and an engine rotational speed of a target propulsion unit, and a control device configured to control the engine rotational speed of the target propulsion unit, wherein the control device is adapted to synchronize the engine rotational speeds of the reference and target propulsion units by correcting the throttle opening of the target propulsion unit based on a deviation between the engine rotational speed of the reference propulsion unit and a natural engine rotational speed of the target propulsion unit that corresponds to a position of the control lever associated with the target propulsion unit, and the control device is configured so that, when synchronization of the engine rotational speeds is cancelled, the correction of the throttle opening of the target propulsion device is a stepwise reduction from the corrected throttle opening to the natural throttle opening.

2. The control system of claim 1, wherein the stepwise reduction from the corrected throttle opening is carried out over a plurality of periods of correction.

3. The control system of claim 2, wherein the amount by which the correction of the throttle opening is reduced in at least one of the plurality of periods of correction is set based on the engine rotational speed of the target propulsion unit.

4. The control system of claim 2, wherein at least one of the plurality of periods of correction of the throttle opening is set based on the engine rotational speed of the target propulsion unit.

5. The control system of claim 4, further comprising a vessel speed detection device arranged to detect a speed of the vessel, and wherein at least one of the plurality of periods of correction of the throttle opening is set based on the speed of the vessel.

6. The control system of claim 4, wherein the amount by which the correction of the throttle opening is reduced in at least one of the plurality of periods of correction is set based on the engine rotational speed of the target propulsion unit.

7. The control system of claim 1, wherein the control device is configured so that cancellation of synchronization of the engine rotational speeds occurs only after the correction of the throttle opening has been completed.

8. A method for controlling a plurality of propulsion units that are mounted side by side on a boat and are electrically connected with two adjacent control levers that are controllable by an operator to operate a shift actuator and/or a throttle actuator of a corresponding one of the propulsion units, the method comprising the steps of:

providing engine rotational speed detection devices, detecting an engine rotational speed of a reference propulsion unit, detecting an engine rotational speed of a target propulsion unit, providing a control device configured to control the engine rotational speed of the target propulsion unit, calculating a deviation between the engine rotational speed of the reference propulsion unit and a natural engine rotational speed of the target propulsion unit that corresponds to a position of the control lever associated with the target propulsion unit, synchronizing the engine rotational speeds of the reference and target propulsion units by correcting the throttle opening of the target propulsion unit based on the calculated deviation, and, upon cancellation of synchronization, reducing the correction of the throttle opening of the target propulsion device as a stepwise reduction from the corrected throttle opening to the natural throttle opening.

9. The method of claim 8, wherein the stepwise reduction from the corrected throttle opening is carried out over a plurality of periods of correction.

10. The method of claim 9, additionally comprising the step of:

setting at least one of the plurality of periods of correction of the throttle opening based on the engine rotational speed of the target propulsion unit.

11. The method of claim 10, further comprising the steps of:

providing a vessel speed detection device, detecting a speed of the vessel, and setting at least one of the plurality of periods of correction of the throttle opening based on the speed of the vessel.

12. The method of claim 11, wherein the amount by which the correction of the throttle opening is reduced in at least one of the plurality of periods of correction is set based on the engine rotational speed of the target propulsion unit.

13. The method of claim 9, wherein the amount by which the correction of the throttle opening is reduced in at least one of the plurality of periods of correction is set based on the engine rotational speed of the target propulsion unit.

* * * * *